US010953532B2

(12) United States Patent
Sunabe et al.

(10) Patent No.: US 10,953,532 B2
(45) Date of Patent: Mar. 23, 2021

(54) ELECTRIC POWER TOOL CONFIGURED TO DETECT TWISTED MOTION

(71) Applicant: MAKITA CORPORATION, Anjo (JP)

(72) Inventors: Hikaru Sunabe, Anjo (JP); Hirokatsu Yamamoto, Anjo (JP); Takaaki Osada, Anjo (JP)

(73) Assignee: MAKITA CORPORATION, Anjo (JP)

( * ) Notice: Subject to any disclaimer, the term of this patent is extended or adjusted under 35 U.S.C. 154(b) by 198 days.

(21) Appl. No.: 15/723,757

(22) Filed: Oct. 3, 2017

(65) Prior Publication Data

US 2018/0099392 A1 Apr. 12, 2018

(30) Foreign Application Priority Data

Oct. 7, 2016 (JP) ..... JP2016-199175

(51) Int. Cl.
*B25D 16/00* (2006.01)
*B25D 17/20* (2006.01)
(Continued)

(52) U.S. Cl.
CPC ..... *B25D 11/005* (2013.01); *B25D 16/006* (2013.01); *B25D 17/043* (2013.01);
(Continued)

(58) Field of Classification Search
CPC .. B25D 11/005; B25D 16/006; B25D 17/043; B25D 17/24; B25D 2216/0015;
(Continued)

(56) References Cited

U.S. PATENT DOCUMENTS 4,574,226 A 3/1986 Binder
5,584,619 A * 12/1996 Guzzella ..... B23Q 11/04 408/9
(Continued)

FOREIGN PATENT DOCUMENTS

JP S60-077694 A 5/1985
JP H7-253192 A 10/1995
(Continued)

OTHER PUBLICATIONS

Sep. 4, 2019 Office Action Issued in U.S. Appl. No. 15/723,587.
(Continued)

*Primary Examiner* — Thanh K Truong
*Assistant Examiner* — David G Shutty
(74) *Attorney, Agent, or Firm* — Oliff PLC

(57) ABSTRACT

An electric power tool is configured to rotate an attachment about a Z-axis. The electric power tool includes a three-axes acceleration sensor and an acceleration detection circuit. The acceleration detection circuit calculates an angular acceleration about the Z-axis based on an input signal from the three-axes acceleration sensor. The acceleration detection circuit calculates a change in an angular velocity based on integrating the angular acceleration for a most recent period. The acceleration detection circuit determines a Z-axis angular velocity about the Z-axis, without adding a previous change in the angular velocity from before the most recent period, as equal to the change in angular velocity. The acceleration detection circuit detects a twisted-motion of the electric power tool based on the Z-axis angular velocity.

20 Claims, 16 Drawing Sheets

(51) Int. Cl.

| | |
|---|---|
| ***B25D 17/24*** | (2006.01) |
| ***F21V 33/00*** | (2006.01) |
| ***B25D 11/00*** | (2006.01) |
| ***B25D 17/04*** | (2006.01) |

(52) U.S. Cl.

CPC ..... *B25D 17/24* (2013.01); *B25D 2216/0015* (2013.01); *B25D 2216/0023* (2013.01); *B25D 2216/0038* (2013.01); *B25D 2216/0084* (2013.01); *B25D 2217/0057* (2013.01); *B25D 2222/72* (2013.01); *B25D 2250/095* (2013.01); *B25D 2250/221* (2013.01); *B25D 2250/265* (2013.01)

(58) Field of Classification Search

CPC .... B25D 2216/0023; B25D 2216/0038; B25D 2216/0084; B25D 2217/0057

See application file for complete search history.

(56) References Cited

U.S. PATENT DOCUMENTS

| | | | | |
|---|---|---|---|---|
| 5,914,882 | A * | 6/1999 | Yeghiazarians | F16P 3/00 408/1 R |
| 6,060,850 | A | 5/2000 | Sakabe | |
| 6,076,616 | A | 6/2000 | Kramp et al. | |
| 6,111,515 | A * | 8/2000 | Schaer | B25F 5/00 340/679 |
| 6,843,326 | B2 | 1/2005 | Tambini | |
| 7,410,006 | B2 * | 8/2008 | Zhang | B23D 59/001 173/1 |
| 7,882,899 | B2 | 2/2011 | Borinato et al. | |
| 8,316,958 | B2 * | 11/2012 | Schell | B25F 5/001 173/178 |
| 8,469,115 | B2 | 6/2013 | Kondo et al. | |
| 9,126,321 | B2 | 9/2015 | Muller et al. | |
| 9,505,097 | B2 | 11/2016 | Aoki et al. | |
| 10,286,529 | B2 | 5/2019 | Kiyohara et al. | |
| 10,675,747 | B2 * | 6/2020 | Gut | B23Q 11/0092 |
| 2002/0003045 | A1 | 1/2002 | Bongers-Ambrosius | |
| 2003/0116332 | A1 | 6/2003 | Nadig et al. | |
| 2004/0119431 | A1 | 6/2004 | Kawano et al. | |
| 2004/0177981 | A1 | 9/2004 | Berger | |
| 2004/0236500 | A1 * | 11/2004 | Choi | G06F 3/0346 701/500 |
| 2005/0023017 | A1 | 2/2005 | Sakai | |
| 2006/0124331 | A1 * | 6/2006 | Stirm | F16D 43/208 173/178 |
| 2007/0289762 | A1 | 12/2007 | Kikukchi et al. | |
| 2008/0319570 | A1 | 12/2008 | Van Schoiack | |
| 2009/0321101 | A1 | 12/2009 | Furusawa et al. | |
| 2011/0114345 | A1 | 5/2011 | Schlesak et al. | |
| 2011/0114347 | A1 | 5/2011 | Kasuya et al. | |
| 2011/0186323 | A1 | 8/2011 | Schneider et al. | |
| 2011/0203821 | A1 | 8/2011 | Puzio et al. | |
| 2011/0284255 | A1 | 11/2011 | Ookubo et al. | |
| 2011/0308827 | A1 | 12/2011 | Kaufmann | |
| 2012/0022820 | A1 * | 1/2012 | Schmitz | G01C 21/165 702/95 |
| 2012/0048580 | A1 | 3/2012 | Appel et al. | |
| 2012/0103643 | A1 | 5/2012 | Binder et al. | |
| 2012/0137776 | A1 | 6/2012 | Ogihara et al. | |
| 2012/0176492 | A1 * | 7/2012 | Garin | G01C 21/165 348/116 |
| 2012/0179408 | A1 * | 7/2012 | Goto | G06F 3/0346 702/104 |
| 2012/0255756 | A1 * | 10/2012 | Aoki | B25D 16/003 173/178 |
| 2012/0279740 | A1 | 11/2012 | Furusawa et al. | |
| 2012/0281386 | A1 | 11/2012 | Kim | |
| 2012/0289377 | A1 | 11/2012 | Aoki | |
| 2012/0318545 | A1 | 12/2012 | Schreiber | |
| 2013/0092408 | A1 | 4/2013 | Oberheim | |
| 2013/0110397 | A1 * | 5/2013 | Walder | G01C 22/006 701/500 |
| 2013/0140050 | A1 | 6/2013 | Eshleman et al. | |
| 2013/0186661 | A1 | 7/2013 | Okubo et al. | |
| 2013/0319710 | A1 * | 12/2013 | Aoki | B23Q 15/08 173/178 |
| 2014/0174777 | A1 | 6/2014 | Kakiuchi et al. | |
| 2014/0196920 | A1 * | 7/2014 | Wirnitzer | B25F 5/00 173/1 |
| 2014/0216773 | A1 | 8/2014 | Steurer | |
| 2014/0231113 | A1 | 8/2014 | Steurer | |
| 2015/0000944 | A1 | 1/2015 | Duesselberg et al. | |
| 2015/0129248 | A1 | 5/2015 | Nitsche et al. | |
| 2015/0231771 | A1 | 8/2015 | Sakai et al. | |
| 2015/0246438 | A1 | 9/2015 | Aoki | |
| 2015/0371454 | A1 * | 12/2015 | Hodel | G07C 3/00 702/34 |
| 2015/0372633 | A1 | 12/2015 | Machida et al. | |
| 2016/0121466 | A1 | 5/2016 | Kiyohara et al. | |
| 2016/0151905 | A1 * | 6/2016 | Tada | B25D 17/20 173/210 |
| 2016/0279776 | A1 * | 9/2016 | Wirnitzer | B25D 11/005 |
| 2016/0279782 | A1 * | 9/2016 | Ullrich | B25F 5/006 |
| 2016/0354911 | A1 | 12/2016 | Aoki et al. | |
| 2017/0336436 | A1 * | 11/2017 | Maegawa | H05K 5/0078 |
| 2018/0304453 | A1 * | 10/2018 | Schaer | B25F 5/001 |
| 2018/0347339 | A1 * | 12/2018 | Zheng | E21B 47/002 |
| 2018/0370008 | A1 | 12/2018 | Peters et al. | |
| 2019/0061081 | A1 * | 2/2019 | Schaer | B25D 16/00 |
| 2019/0063925 | A1 * | 2/2019 | Barbier | G01C 21/12 |
| 2019/0072653 | A1 * | 3/2019 | Dunne | G01S 17/10 |

FOREIGN PATENT DOCUMENTS

| | | | |
|---|---|---|---|
| JP | H10-248284 | A | 9/1998 |
| JP | 2004-518551 | A | 6/2004 |
| JP | 2004-194422 | A | 7/2004 |
| JP | 3638977 | B2 | 4/2005 |
| JP | 2005-353004 | A | 12/2005 |
| JP | 2007-331072 | A | 12/2007 |
| JP | 2008-178935 | A | 8/2008 |
| JP | 2011-041187 | A | 2/2011 |
| JP | 2011-104736 | A | 6/2011 |
| JP | 2012-076160 | A | 4/2012 |
| JP | 2012-80411 | A | 4/2012 |
| JP | 2013-244581 | A | 12/2013 |
| JP | 2014-069264 | A | 4/2014 |
| JP | 2014-148001 | A | 8/2014 |
| JP | 2015-009302 | A | 1/2015 |
| JP | 2015-066635 | A | 4/2015 |
| JP | 2015-517411 | A | 6/2015 |
| JP | 2015-150664 | A | 8/2015 |
| JP | 2015-169582 | A | 9/2015 |
| JP | 2016-144856 | A | 8/2016 |
| WO | 2014208125 | A1 | 12/2014 |

OTHER PUBLICATIONS

Oct. 21, 2019 Office Action Issued in U.S. Appl. No. 15/724,766.

Sep. 11, 2019 Office Action issued in U.S. Appl. No. 15/720,451.

Endevco, "Steps to Selecting the Right Accelerometer", website: https://www.endevco.com/news/newsletter/2012_07/tp327.pdf, (Year: 2012).

Mar. 13, 2020 Office Action Issued in U.S. Appl. No. 15/723,587.

Mar. 19, 2020 Office Action Issued in U.S. Appl. No. 15/720,451.

Apr. 28, 2020 Office Action issued in Japanese Patent Application No. 2016-199175.

May 6, 2020 Notice of Allowance Issued in U.S. Appl. No. 15/724,766.

May 19, 2020 Office Action issued in Japanese Patent Application No. 2016-199176.

Jun. 8, 2020 Advisory Action issued in U.S. Appl. No. 15/723,587.

Jul. 9, 2020 Office Action issued in U.S. Appl. No. 15/720,451.

Jul. 7, 2020 Notice of Reasons for Rejection issued in Japanese Patent Application No. 2016-199173.

Dec. 10, 2020 Office Action Issued in U.S. Appl. No. 15/720,451.

(56) References Cited

OTHER PUBLICATIONS

Nov. 2, 2020 Office Action issued in Japanese Patent Application No. 2016-199176.

* cited by examiner

ELECTRIC POWER TOOL CONFIGURED TO DETECT TWISTED MOTION

CROSS-REFERENCE TO RELATED APPLICATIONS

This application claims the benefit of Japanese Patent Application No. 2016-199175, filed on Oct. 7, 2016; the entire disclosure of which is incorporated herein by reference.

BACKGROUND

The present disclosure relates to an electric power tool.

A drilling tool for drilling a work piece by the rotation of a tool bit and a fastener tool for fastening a screw or bolt are known as electric power tools.

With this kind of electric power tool, the tip bit may fit to the work piece or the like and the tool main body may be twisted in the circumferential direction of the output shaft attached with the tool bit.

Japanese Patent No. 3638977 discloses that in this kind of electric power tool, twisting of a tool main body is detected using a rotation acceleration sensor. Japanese Patent No. 3638977 further discloses that drive of a motor is stopped when twisting is detected.

SUMMARY

In this disclosed electric power tool, a detection signal from the rotation acceleration sensor is integrated in a two-stage integration circuit and the rotation angle of the tool main body is therefore calculated. When the calculated rotation angle exceeds a predetermined angle, the motor is stopped.

However, a detection signal from an acceleration sensor provided in the electric power tool includes an unwanted signal such as noise. Accordingly, a speed or a rotation angle determined from the integral of the detection signal includes errors.

During the use of an electric power tool, in the case of continuous execution of the integration of a detection signal, the errors may be accumulated and the speed or the rotation angle may increase or decrease with no limits. Such increase or decrease hinders normal detection of twisting.

In one aspect of the present disclosure, it is preferable to accurately detect twisting of the tool main body in the electric power tool.

An electric power tool according to one aspect of the present disclosure includes a housing, a motor, and an output shaft. The housing houses the motor and the output shaft. The output shaft includes a first end for attachment to a tool bit. The output shaft is configured to be rotatively driven by the motor.

The electric power tool may further include an acceleration sensor and a twisted-motion detector. The acceleration sensor may be configured to detect acceleration imposed on the housing. The twisted-motion detector may be configured to detect twisting of the housing.

The twisted-motion detector may be configured to repeatedly obtain acceleration of the housing in the circumferential direction of the output shaft from the acceleration sensor. The twisted-motion detector may be configured to calculate the speed by integrating, of the obtained accelerations, accelerations obtained in a certain period. The twisted-motion detector may be configured to detect twisting of the housing from the calculated speed.

The electric power tool may include a rotation restrainer that is configured to restrain drive of the motor in response to the twisted-motion detector detecting twisting of the housing. The electric power tool may also include a rotation stopper that is configured to stop drive of the motor in response to the twisted-motion detector detecting twisting of the housing.

Calculating the speed by integration of accelerations obtained in a certain period can reduce errors accumulated in the speed due to noise and the like.

The housing can be twisted when the tool bit fits to a work piece or the like. Reducing errors leads to proper detection of twisting of the housing. For example, even when the motor is driven for long time, twisting of the housing can be properly detected.

The twisted-motion detector may be configured to weight accelerations obtained in the certain period such that the weight of an acceleration obtained at a first time is higher than that obtained at a second time, which is prior to the first time, and integrate the weighted accelerations to calculate the speed.

The integral (i.e., speed) of the weighted accelerations largely changes when the housing abruptly rotates about the output shaft, compared with the integral of non-weighted accelerations. Such weighting allows a twisted-motion of the housing to be satisfactorily detected.

The certain period may include at least a first period and a second period prior to the first period. The twisted-motion detector may obtain acceleration more than once in each of the first period and the second period. The twisted-motion detector may weight accelerations obtained in the second period such that the weights of the accelerations obtained in the second period are lower than the weights of accelerations obtained in the first period. The twisted-motion detector may calculate the speed by integrating the weighted accelerations. The twisted-motion detector may be configured to weight accelerations obtained in the second period such that the weight of an acceleration obtained at a first time is higher than that obtained at a second time, which is prior to the first time.

The certain period may include multiple periods. The twisted-motion detector may obtain acceleration more than once in each of the multiple periods. The twisted-motion detector may be configured to weight accelerations obtained in each period such that the weights of the accelerations obtained in, of the multiple periods, the periods prior to the latest period are lower than the weights of accelerations obtained in the latest period, and calculate the speed by integrating the weighted accelerations.

The acceleration sensor may be configured to output a detection signal indicating an acceleration. The twisted-motion detector may be configured to obtain the acceleration based on the detection signal with unwanted signal components removed by a digital filter. The digital filter may include a high-pass filter.

The digital filter may function such that an unwanted low-frequency signal component, such as a gravity acceleration component, is removed from the detection signal. The use of a digital filter is advantageous over the use of an analog filter in the accuracy of the detection of acceleration.

The twisted-motion detector may be configured to calculate the rotation angle of the housing in the circumferential direction of the output shaft by further integrating the speed calculated by integrating the accelerations, and to detect twisting of the housing from the rotation angle.

The twisted-motion detector may be configured to estimate the rotation angle of the housing during the time until when the motor stops, based on the speed calculated by integrating the accelerations. The twisted-motion detector may be configured to detect twisting of the housing, based on an angle calculated by adding the estimated rotation angle to the rotation angle calculated by integrating the speed.

Estimation of a rotation angle can define an allowable rotation angle during twisting of the housing about the output shaft. Accordingly, upon occurrence of a twisted-motion, the rotation of the motor (and thus the housing) can be stopped in a more appropriate timing.

One aspect of the present disclosure may provide a method of detecting a twisted-motion of a main body of an electric power tool. The method may include repeatedly obtaining acceleration of the main body in a circumferential direction of an output shaft of the electric power tool from an acceleration sensor configured to detect the acceleration of the main body. The method may include calculating a speed of the main body in the circumferential direction of the output shaft by integrating, of the obtained accelerations, accelerations obtained in a certain period. The method may also include detecting twisting of the main body based on the calculated speed.

BRIEF DESCRIPTION OF THE DRAWINGS

An example embodiment of the present disclosure will be described hereinafter with reference to the accompanying drawings, in which.

DETAILED DESCRIPTION OF THE PREFERRED EMBODIMENTS

A hammer drill 2 of this embodiment is configured to perform chipping or drilling on a work piece (e.g., concrete) by a hammering by a tool bit 4, such as a hammer bit, along the longer axis of the tool bit 4 or rotating it about the longer axis.

Figure 1:
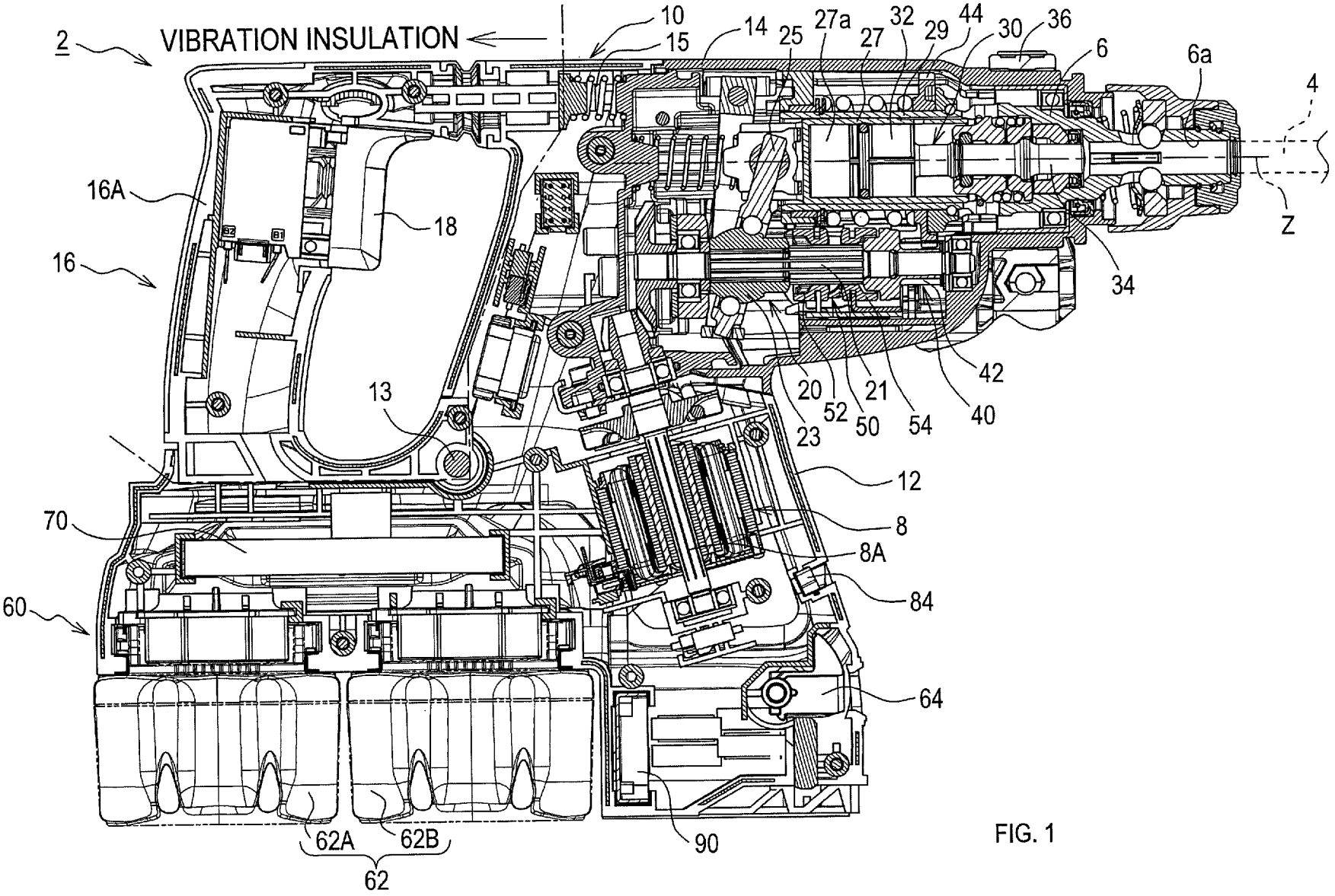
FIG. 1 is a cross-sectional view of a structure of a hammer drill of one embodiment.

As shown in FIG. 1, the hammer drill 2 includes a main body housing 10 defining the contour of the hammer drill 2. The tool bit 4 is detachably attached to the tip of the main body housing 10 through a tool holder 6. The tool holder 6 has a cylindrical shape and functions as an output shaft.

The tool bit 4 is inserted in a bit insertion hole 6*a* in the tool holder 6 and held by the tool holder 6. The tool bit 4 can reciprocate along the longer axis of the tool bit 4 against the tool holder 6 but its rotational motion about the longer axis of the tool bit 4 against the tool holder 6 is restricted.

The main body housing 10 includes a motor housing 12 and a gear housing 14. The motor housing 12 houses a motor 8. The gear housing 14 houses a motion converting mechanism 20, a hammering element 30, a rotation transmitting mechanism 40, and a mode switching mechanism 50.

The main body housing 10 is connected to a hand grip 16 on the opposite side to the tool holder 6. The hand grip 16 includes a hold part 16A which is held by an operator. This hold part 16A extends in a direction orthogonal to the longer axis of the tool bit 4 (i.e., the center shaft of the tool holder 6) (the vertical direction in FIG. 1), and a part of the hold part 16A is on the extension (i.e., the longer axis) of the tool bit 4.

A first end of the hold part 16A (i.e., the end adjacent to the longer axis of the tool bit 4) is connected to the gear housing 14, and a second end of the hold part 16A (i.e., the end remote from the longer axis of the tool bit 4) is connected to the motor housing 12.

The hand grip 16 is fixed to the motor housing 12 such that it can swing about a support shaft 13. The hand grip 16 and the gear housing 14 are connected to each other through a vibration-insulating spring 15.

The spring 15 restrains vibrations that occur in the gear housing 14 (i.e., the main body housing 10) due to a hammering operation of the tool bit 4, so that vibrations from the main body housing 10 to the hand grip 16 are restrained.

In the description below, for convenience of description, the side on which the tool bit 4 is disposed along the longer axis direction parallel with the longer axis of the tool bit 4 is defined as the front side. The side on which the hand grip 16 is disposed along the longer axis direction is defined as the back side. The side on which a joint between the hand grip 16 and the gear housing 14 is disposed along a direction which is orthogonal to the longer axis direction and in which the hold part 16A extends (i.e., the vertical direction of FIG. 1) is defined as the upper side. The side on which a joint between the hand grip 16 and the motor housing 12 is disposed along the vertical direction of FIG. 1 is defined as the lower side.

Further, in the description below, the Z axis is defined as an axis that extends along the longer axis of the tool bit 4 (i.e., the center shaft of the tool holder 6 serving as the output shaft), the Y axis is defined as an axis that is orthogonal to the Z axis and extends in the vertical direction, and the X axis is defined as an axis that is orthogonal to the Z axis and the Y axis and extends in the horizontal direction (i.e., the width direction of the main body housing 10) (see FIG. 2).

In the main body housing 10, the gear housing 14 is disposed on the front side and the motor housing 12 is disposed on the lower side of the gear housing 14. In addition, the hand grip 16 is joined to the back side of the gear housing 14.

In this embodiment, the motor 8 housed in the motor housing 12 is a brushless motor but not limited to a brushless motor in the present disclosure. The motor 8 is disposed such that the rotation shaft 8A of the motor 8 intersects the longer axis of the tool bit 4 (i.e., the Z axis). In other words, the rotation shaft 8A extends in the vertical direction of the hammer drill 2.

Figure 2:
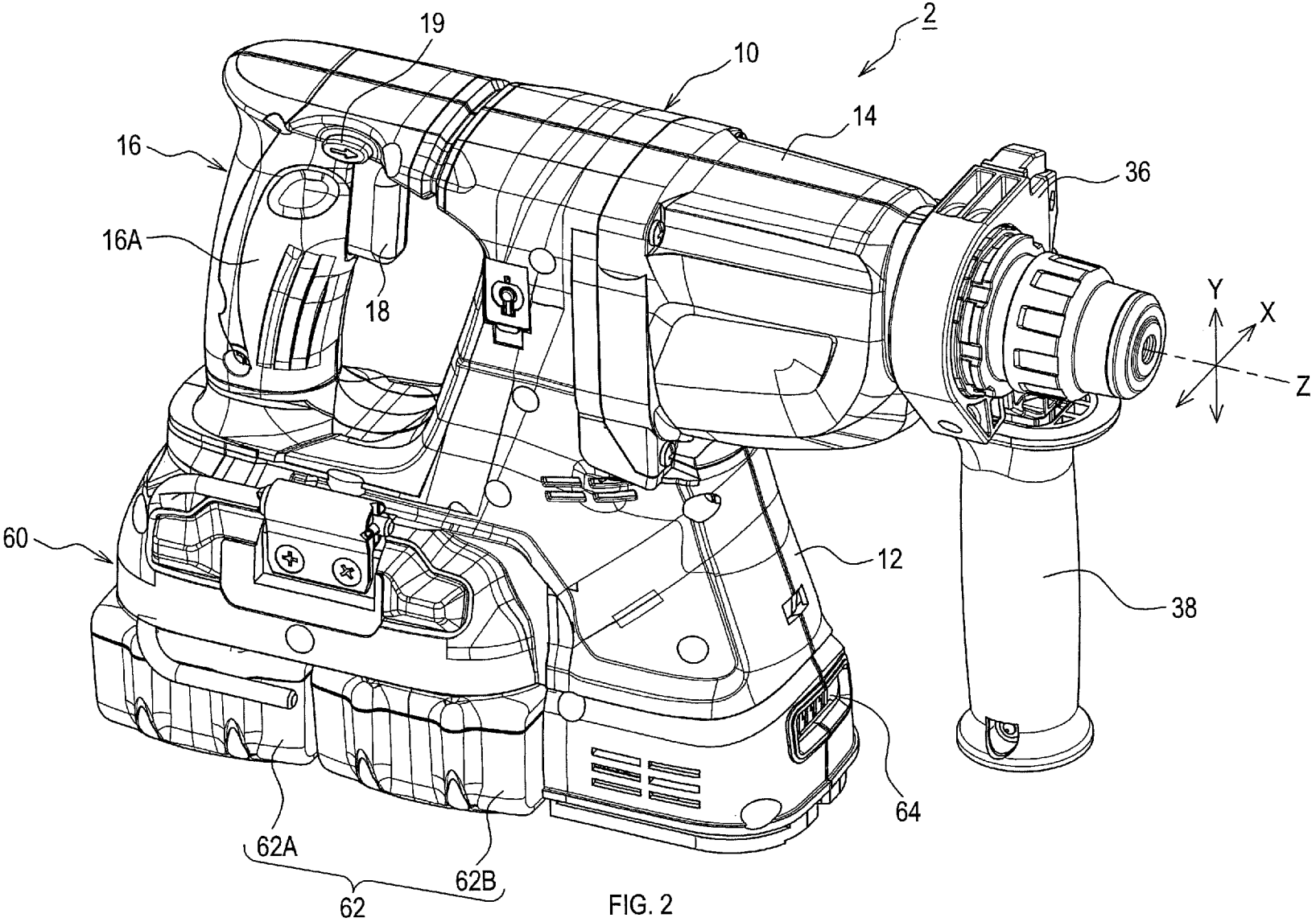
FIG. 2 is a perspective view of the external view of the hammer drill.

As shown in FIG. 2, in the gear housing 14, a holder grip 38 is attached to the outer area of the tip region from which the tool bit 4 protrudes, through an annular fixer member 36. Like the hand grip 16, the holder grip 38 is configured to be gripped by the user. To be specific, the user grips the hand grip 16 with one hand and the holder grip 38 with the other hand, thereby securely holding the hammer drill 2.

Figure 3:
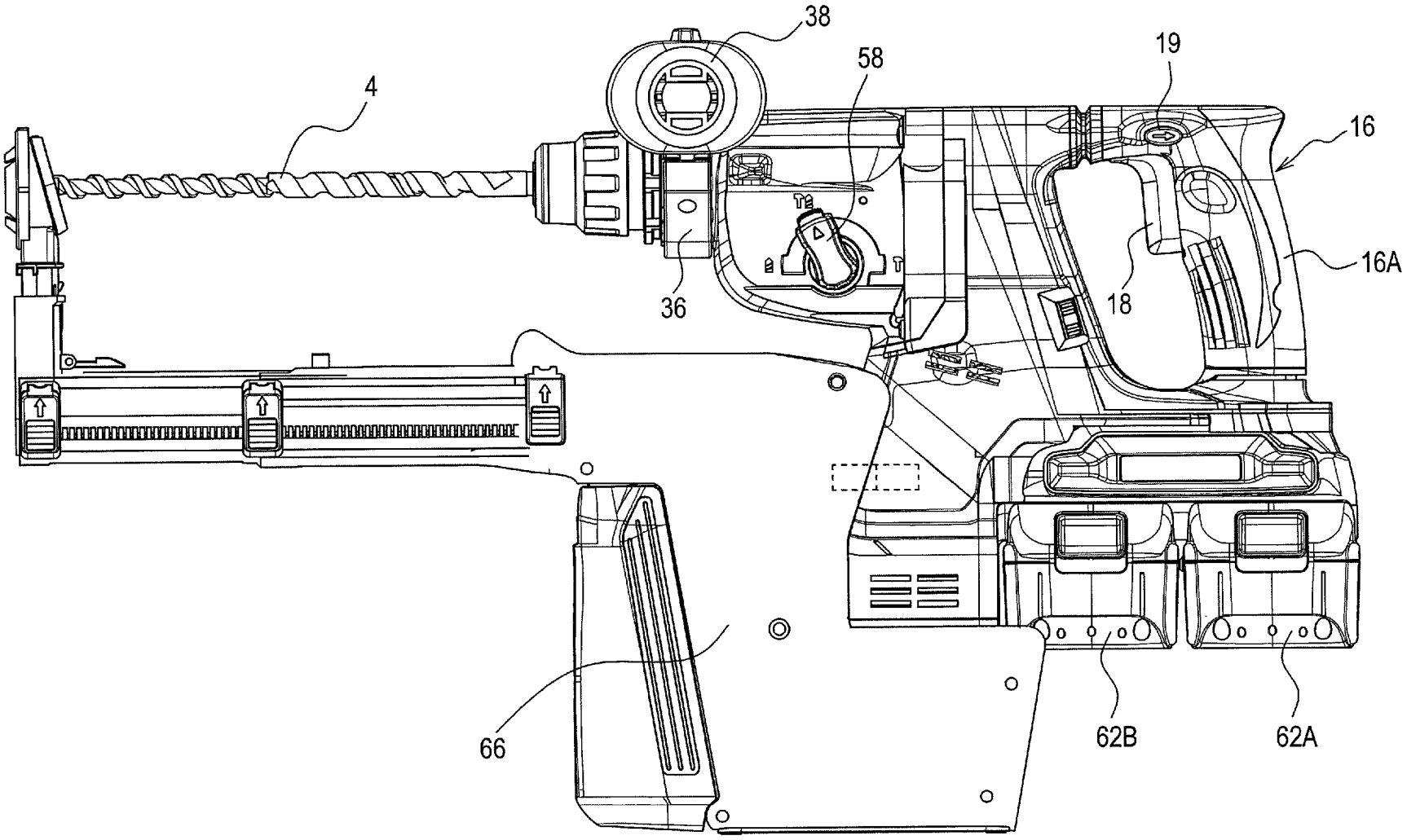
FIG. 3 is a side view of the hammer drill with a dust collector device attached thereto.

As shown in FIG. 3, a dust collector device 66 is mounted to the front side of the motor housing 12. To mount the dust collector device 66, as shown in FIGS. 1 and 2, a depressed portion is provided on the lower and front portion of the motor housing 12 (i.e., the lower and front portion of the motor 8) for fixation of the dust collector device 66. A connector 64 for electrical connection to the dust collector device 66 is provided in the depressed portion.

Further, a twisted-motion detector 90 is accommodated in a lower portion of the motor housing 12 (i.e., in a lower portion of the motor 8). When the tool bit 4 is rotated for a drilling operation and the tool bit 4 fits in the work piece, the twisted-motion detector 90 detects twisting of the main body housing 10.

Battery packs 62A and 62B serving as the power source of the hammer drill 2 are provided on the back side of the container region of the twisted-motion detector 90. The battery packs 62A and 62B are detachably attached to a battery port 60 provided on the lower side of the motor housing 12.

The battery port 60 is higher than the lower end surface of the container region of the twisted-motion detector 90 (i.e., the bottom surface of the motor housing 12). The lower end surfaces of the battery packs 62A and 62B attached to the battery port 60 flush with the lower end surface of the container region of the twisted-motion detector 90.

A motor controller 70 is provided on the upper side of the battery port 60 in the motor housing 12. The motor controller 70 controls drive of the motor 8, receiving electric power from the battery packs 62A and 62B.

The rotation of the motor 8 is converted to a linear motion by the motion converting mechanism 20 and then transmitted to the hammering element 30. The hammering element 30 generates impact force in the direction along the longer axis of the tool bit 4. The rotation of the motor 8 is decelerated by the rotation transmitting mechanism 40 and transmitted also to the tool bit 4. In other words, the motor 8 rotatively drives the tool bit 4 about the longer axis. The motor 8 is driven in accordance with the pulling operation on a trigger 18 disposed on the hand grip 16.

As shown in FIG. 1, the motion converting mechanism 20 is disposed on the upper side of the rotation shaft 8A of the motor 8.

The motion converting mechanism 20 includes a countershaft 21, a rotating object 23, a swing member 25, a piston 27, and a cylinder 29. The countershaft 21 is disposed to intersect the rotation shaft 8A and is rotatively driven by the rotation shaft 8A. The rotating object 23 is attached to the countershaft 21. The swing member 25 is swung in the back and forth direction of the hammer drill 2 with the rotation of the countershaft 21 (the rotating object 23). The piston 27 is a bottomed cylindrical member slidably housing a striker 32 which will be described later. The piston 27 reciprocates in the back and forth direction of the hammer drill 2 with the swing of the swing member 25.

The cylinder 29 is integrated with the tool holder 6. The cylinder 29 houses the piston 27 and defines a back region of the tool holder 6.

As shown in FIG. 1, the hammering element 30 is disposed on the front side of the motion converting mechanism 20 and on the back side of the tool holder 6. The hammering element 30 includes the above-described striker 32 and an impact bolt 34. The striker 32 serves as a hammer and strikes the impact bolt 34 disposed on the front side of the striker 32.

The space in the piston 27 on the back side of the striker 32 defines an air chamber 27*a*, and the air chamber 27*a* serves as an air spring. Accordingly, the swing of the swing member 25 in the back and forth direction of the hammer drill 2 causes the piston 27 to reciprocate in the back and forth direction, thereby driving the striker 32.

In other words, the forward motion of the piston 27 causes the striker 32 to move forward by the act of the air spring and strike the impact bolt 34. Accordingly, the impact bolt 34 is moved forward and strikes the tool bit 4. Consequently, the tool bit 4 hammers the work piece.

In addition, the backward motion of the piston 27 moves the striker 32 backward and thereby makes the pressure of the air in the air chamber 27*a* positive with respect to atmospheric pressure. Further, reaction force generated when the tool bit 4 hammers the work piece also moves the striker 32 and the impact bolt 34 backward.

This causes the striker 32 and the impact bolt 34 to reciprocate in the back and forth direction of the hammer drill 2. The striker 32 and the impact bolt 34, which are driven by the act of the air spring of the air chamber 27*a*, move in the back and forth direction, following the motion of the piston 27 in the back and forth direction.

As shown in FIG. 1, the rotation transmitting mechanism 40 is disposed on the front side of the motion converting mechanism 20 and on the lower side of the hammering element 30. The rotation transmitting mechanism 40 includes a gear deceleration mechanism. The gear deceleration mechanism includes a plurality of gears including a first gear 42 rotating with the countershaft 21 and a second gear 44 to be engaged with the first gear 42.

The second gear 44 is integrated with the tool holder 6 (specifically, the cylinder 29) and transmits the rotation of the first gear 42 to the tool holder 6. Thus, the tool bit 4 held by the tool holder 6 is rotated. The rotation of the motor 8 is decelerated by, in addition to the rotation transmitting mechanism 40, a first bevel gear that is provided at the front tip of the rotation shaft 8A and a second bevel gear that is provided at the back tip of the countershaft 21 and engages with the first bevel gear.

The hammer drill 2 of this embodiment has three drive modes including a hammer mode, a hammer drill mode, and a drill mode.

In the hammer mode, the tool bit 4 performs a hammering operation along the longer axis direction, thereby hammering the work piece. In the hammer drill mode, the tool bit 4 performs a rotation operation about the longer axis in addition to a hammering operation, so that the work piece is drilled while being hammered by the tool bit 4. In the drill mode, the tool bit 4 does not perform a hammering operation and only performs a rotation operation, so that the work piece is drilled.

The drive mode is switched by the mode switching mechanism 50. The mode switching mechanism 50 includes rotation transmitting members 52 and 54 shown in FIG. 1 and a switching dial 58 shown in FIG. 3.

The rotation transmitting members 52 and 54 are generally cylindrical members and movable along the countershaft 21. The rotation transmitting members 52 and 54 are spline-engaged with the countershaft 21 and rotate in cooperation with the countershaft 21.

The rotation transmitting member 52 moving toward the back side of the countershaft 21 is engaged with an engagement groove on the front of the rotating object 23 and transmits the rotation of the motor 8 to the rotating object 23. Consequently, the drive mode of the hammer drill 2 is set to the hammer mode or the hammer drill mode.

The rotation transmitting member 54 moving toward the front side of the countershaft 21 is engaged with the first gear 42 and transmits the rotation of the motor 8 to the first gear 42. Consequently, the drive mode of the hammer drill 2 is set to the hammer drill mode or the drill mode.

The switching dial 58 turned by the user displaces the rotation transmitting members 52 and 54 on the countershaft 21. The switching dial 58 is turned and set to any of the three positions shown in FIG. 3, thereby setting the drive mode of the hammer drill 2 to any of the modes: the hammer mode, the hammer drill mode, and the drill mode.

The structures of the motor controller 70 and the twisted-motion detector 90 will now be described with reference to FIG. 4.

The twisted-motion detector 90 includes an acceleration sensor 92 and an acceleration detecting circuit 94. The acceleration sensor 92 and the acceleration detecting circuit 94 are mounted on a common circuit board and contained in a common case.

The acceleration sensor 92 detects accelerations (more specifically, values of accelerations) in the directions along three axes (i.e., the X axis, the Y axis, and the Z axis).

The acceleration detecting circuit 94 subjects detection signals from the acceleration sensor 92 to process to detect twisting of the main body housing 10.

To be specific, the acceleration detecting circuit 94 includes a micro controller unit (MCU) including a CPU, a ROM, and a RAM. The acceleration detecting circuit 94 executes a twisted-motion detecting process, which will be described later, to detect the rotation of the main body housing 10 about the Z axis (i.e., the longer axis of the tool bit 4) over a predetermined angle, in accordance with detection signals (specifically, an output based on acceleration in the direction of the X axis) from the acceleration sensor 92. The Z axis corresponds to the output shaft of the hammer drill 2.

The acceleration detecting circuit 94 further executes an acceleration load detecting process to detect, using the acceleration sensor 92, vibrations (more specifically, magnitude of vibrations) that occur in the main body housing 10 in the directions of the three axes due to a hammering operation of the tool bit 4. In this acceleration load detecting process, the acceleration detecting circuit 94 detects imposition of a load on the tool bit 4 if a vibration in the main body housing 10 (i.e., acceleration) exceeds a threshold.

The motor controller 70 includes a drive circuit 72 and a control circuit 80. The drive circuit 72 and the control circuit 80 are mounted on another common circuit board together with various detection circuits, which will be described later, and contained in another common case.

The drive circuit 72 includes switching devices Q1 to Q6 and is configured to receive electric power from a battery pack 62 (specifically, series-connected battery packs 62A and 62B) and feed current to a plurality of phase windings in the motor 8 (which is, specifically, a three-phase brushless motor). The switching devices Q1 to Q6 in this embodiment are FETs but not limited to FETs in the present disclosure. The switching devices Q1 to Q6 in another embodiment may be switching devices other than FETs.

The switching devices Q1 to Q3 are each provided as a so-called high side switch between a power source line and one corresponding terminal selected from the terminals U, V, and W of the motor 8. The power source line is coupled to the positive terminal of the battery pack 62.

The switching devices Q4 to Q6 are each provided as a so-called low side switch between a ground line and one corresponding terminal selected from the terminals U, V, and W of the motor 8. The ground line is coupled to the negative terminal of the battery pack 62.

A capacitor C1 for restraining fluctuations in battery voltage is provided in a power supply path from the battery pack 62 to the drive circuit 72.

Like the acceleration detecting circuit 94, the control circuit 80 includes an MCU including a CPU, a ROM, and a RAM. The control circuit 80 feeds current to a plurality of phase windings in the motor 8 by turning on and off the switching devices Q1 to Q6 in the drive circuit 72, and rotates the motor 8.

To be specific, the control circuit 80 sets the command rotational speed and rotation direction of the motor 8 in accordance with commands from a trigger switch 18*a*, a speed change commander 18*b*, an upper-limit speed setter 96, and a rotation direction setter 19, and controls drive of the motor 8.

The trigger switch 18*a* is turned on by pulling the trigger 18 and is configured to input a drive command for the motor 8 to the control circuit 80. The speed change commander 18*b* is configured to generate a signal depending on the amount of pulling operation of the trigger 18 (i.e., the operation rate) and vary the command rotational speed depending on this amount of operation.

The upper-limit speed setter 96 includes a not-shown dial. The operational position of the dial is switched by the user of the hammer drill 2 stage by stage. The upper-limit speed setter 96 is configured to set the upper limit of rotational speed of the motor 8 depending on the operational position of the dial.

To be specific, the upper-limit speed setter 96 is configured to be able to set the upper limit of the rotational speed of the motor 8 between a rotational speed higher than a no-load rotational speed under soft no load control, which will be described later, and a rotational speed lower than the no-load rotational speed.

The rotation direction setter 19 is configured to set the rotation direction of the motor 8 to a normal or opposite direction through the operation by the user, and is provided, in this embodiment, on the upper side of the trigger 18 as shown in FIGS. 2 and 3. Rotating the motor 8 in a normal direction enables drilling of the work piece.

The control circuit 80 sets the command rotational speed of the motor 8 in accordance with a signal from the speed change commander 18*b* and an upper limit rotational speed set through the upper-limit speed setter 96. In particular, the control circuit 80 sets a command rotational speed dependent on the amount of the operation (the operation rate) of the trigger 18 such that the rotational speed of the motor 8 reaches the upper limit rotational speed set by the upper-limit speed setter 96, when the trigger 18 is pulled to a maximum extent.

The control circuit 80 sets a drive duty ratio among the switching devices Q1 to Q6 rotatively drives the motor 8 by transmitting a control signal based on the drive duty ratio to the drive circuit 72, in accordance with the set command rotational speed and rotation direction.

An LED 84 serving as a lighting (hereinafter referred to as "lighting LED 84") is provided in the front side of the motor housing 12. When the trigger switch 18*a* is turned on, the control circuit 80 turns on the lighting LED 84 to illuminate a portion of the work piece to be processed with the tool bit 4.

Rotational position sensors 81 are provided to the motor 8. The rotational position sensors 81 detect the rotational speed and rotational position of the motor 8 (to be specific, the rotational position of the rotor of the motor 8), and transmit detection signals to the motor controller 70. The motor controller 70 includes a rotational position detection circuit 82. The rotational position detection circuit 82 detects the rotational position needed for setting the timing of energization of each phase winding in the motor 8, in accordance with detection signals from the rotational position sensors 81.

The motor controller 70 further includes a voltage detection circuit 78, a current detection circuit 74, a temperature detection circuit 76, and a temperature sensor 75.

The voltage detection circuit 78 detects the value of a battery voltage supplied from the battery pack 62. The current detection circuit 74 detects the value of a current flowing through the motor 8 via a resistor R1 provided in an current path to the motor 8.

The temperature detection circuit 76 detects the temperature of the motor controller 70.

The control circuit 80 receives detection signals from the voltage detection circuit 78, the current detection circuit 74, the temperature detection circuit 76, and the rotational position detection circuit 82, and detection signals from the twisted-motion detector 90.

The control circuit 80 restricts the rotational speed of the motor 8 that is being driven or stops drive of the motor 8, in accordance with detection signals from the voltage detection circuit 78, the current detection circuit 74, the temperature detection circuit 76, and the rotational position detection circuit 82.

The motor controller 70 includes a not-shown regulator for receiving power from the battery pack 62 and generating a constant power source voltage Vcc.

The power source voltage Vcc generated by the regulator is supplied to the MCU of the control circuit 80 and the acceleration detecting circuit 94 of the twisted-motion detector 90. In addition, upon detection of twisting of the main body housing 10 from the acceleration in the direction of the X axis, the acceleration detecting circuit 94 transmits an error signal to the control circuit 80.

This error signal is transmitted for stopping drive of the motor 8. When the main body housing 10 is not twisted, the acceleration detecting circuit 94 transmits a no-error signal to the control circuit 80.

Upon detection of imposition of a load to the tool bit 4 from vibration (i.e., acceleration) of the main body housing 10, the acceleration detecting circuit 94 transmits a load signal to the control circuit 80. The load signal indicates the fact that the tool bit 4 is in a load-imposed state. When the acceleration detecting circuit 94 does not detect imposition of a load to the tool bit 4, the acceleration detecting circuit 94 transmits a no-load signal to the control circuit 80. The no-load signal indicates the fact that the tool bit 4 is in a no-load-imposed state.

The dust collector device 66 mounted on the front side of the motor housing 12 collects, by suction, dust particles that occur from the work piece upon chipping and drilling.

Figure 4:
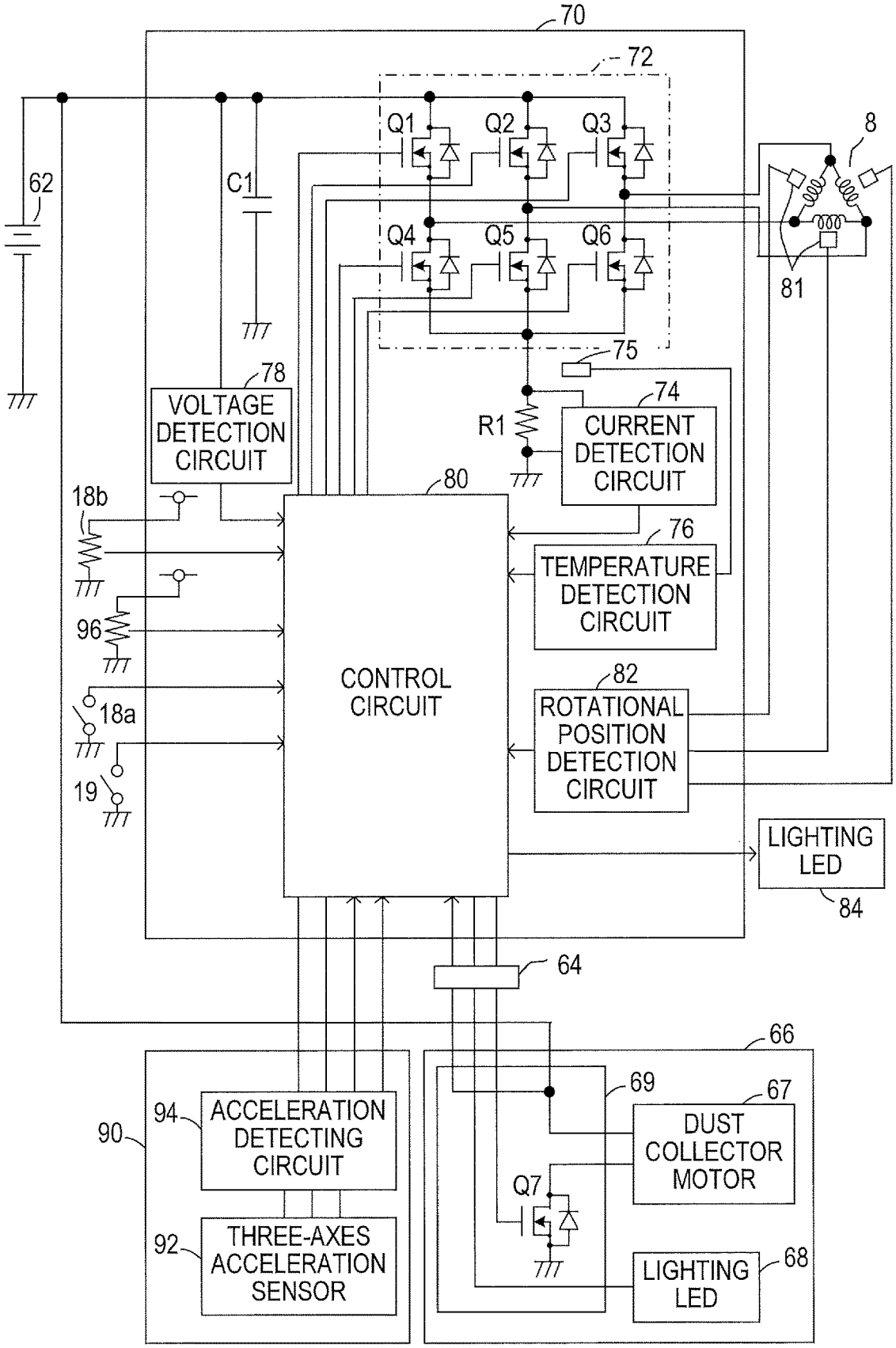
FIG. 4 is a block diagram showing an electrical configuration of a drive system of the hammer drill.

As shown in FIG. 4, the dust collector device 66 includes a dust collector motor 67 and a circuit board 69. The dust collector motor 67 is driven by the circuit board 69. The dust collector device 66 includes a lighting LED 68 that has a function of illuminating a portion of the work piece to be processed, instead of the lighting LED 84 provided to the motor housing 12. This is because the lighting LED 84 is covered when the dust collector device 66 is mounted to the motor housing 12.

When the dust collector device 66 is mounted to the motor housing 12, drive current is fed from the battery pack 62 to the dust collector motor 67 through the current path on the circuit board 69.

When the dust collector device 66 is mounted to the motor housing 12, the circuit board 69 is coupled to the control circuit 80 through the connector 64. The circuit board 69 includes the switching device Q7 and turns on and off the switching device Q7 to open and close the current path to the dust collector motor 67. The lighting LED 68 can be turned on by a drive signal from the control circuit 80.

Control process performed in the control circuit 80 will now be explained with the flow charts of FIGS. 5 to 11. It should be noted that this control process is implemented when the CPU in the control circuit 80 executes a program stored in the ROM which is a nonvolatile memory.

Figure 5:
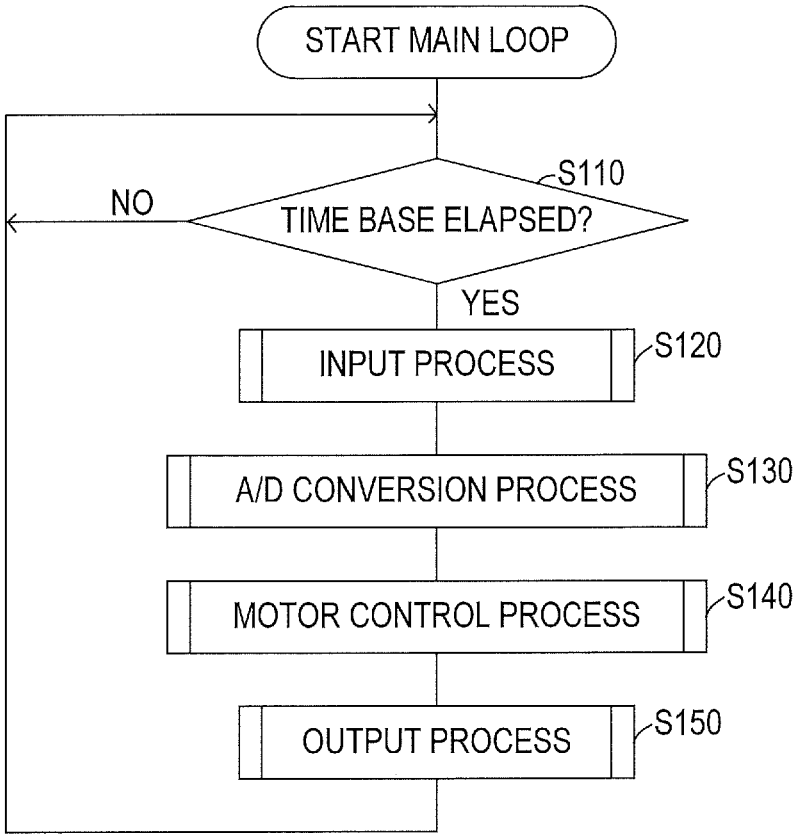
FIG. 5 is a flow chart of control process executed in a control circuit in a motor controller.

As shown in FIG. 5, in this control process, whether a given time base has elapsed is first determined in S110 (S represents Step) and a waiting time lasts until the elapse of the time base from the execution of the previous process from S120. This time base corresponds to the cycle for controlling drive of the motor.

If it is determined that the time base has elapsed in S110, input process in S120, A/D conversion process in S130, motor control process in S140, and output process in S150 are sequentially executed and the process goes to S110 again. In other words, in this control process, the CPU in the control circuit 80 executes a series of process in S120 to S150 each elapse of the time base, that is, in a cyclical fashion.

Figure 6:
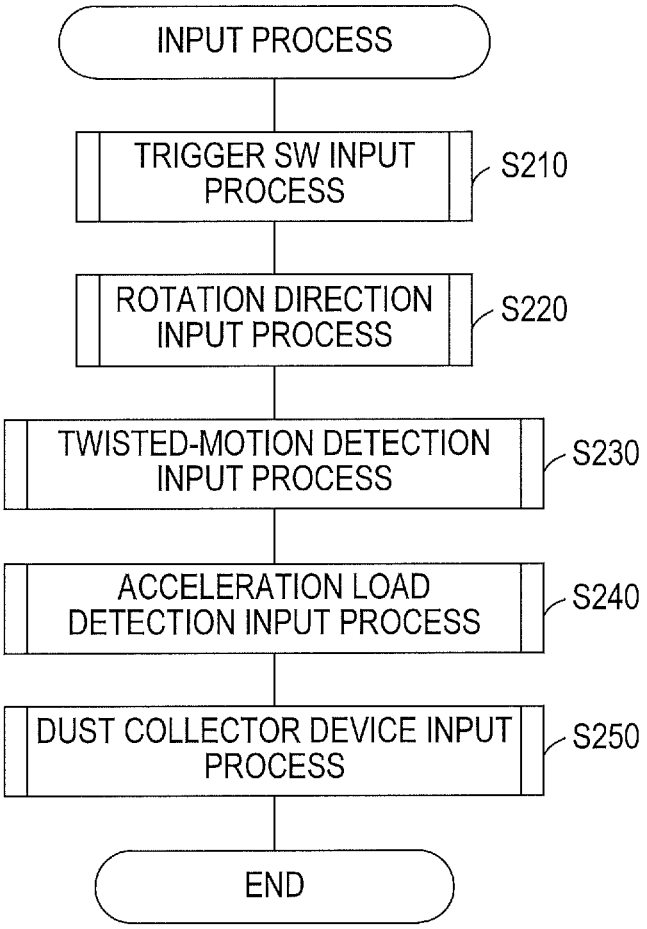
FIG. 6 is a flow chart showing details of an input process shown in FIG. 5.

Here, in input process in S120, as shown in FIG. 6, trigger switch (trigger SW) input process is first executed in S210 for retrieving the operation state of the trigger 18 from the trigger switch 18*a*. In the following S220, rotation direction input process is executed for retrieving the direction of the rotation of the motor 8 from the rotation direction setter 19.

In the following S230, a twisted-motion detection input process is executed for retrieving the results of detection (an error signal or no-error signal) of a twisted-motion from the twisted-motion detector 90. In the following S240, acceleration load detection input process is executed for retrieving the results of detection of an acceleration load from the twisted-motion detector 90 (a load signal or no-load signal).

Finally, in S250, dust collector device input process is executed for detecting the value of the battery voltage through the connector 64 of the dust collector device 66, and the input process in S120 is terminated. It should be noted that the dust collector device input process in S250 detects the value of the battery voltage in order to determine whether the dust collector device 66 is mounted to the motor housing 12.

In the following A/D conversion process in S130, detection signals (voltage signals) related to the amount of pulling operation of the trigger 18 and upper-limit speed, or a voltage value, a current value, a temperature, and the like are retrieved, through A/D conversion, from the speed change commander 18*b*, the upper-limit speed setter 96, the voltage detection circuit 78, the current detection circuit 74, the temperature detection circuit 76 and the like.

Figure 7:
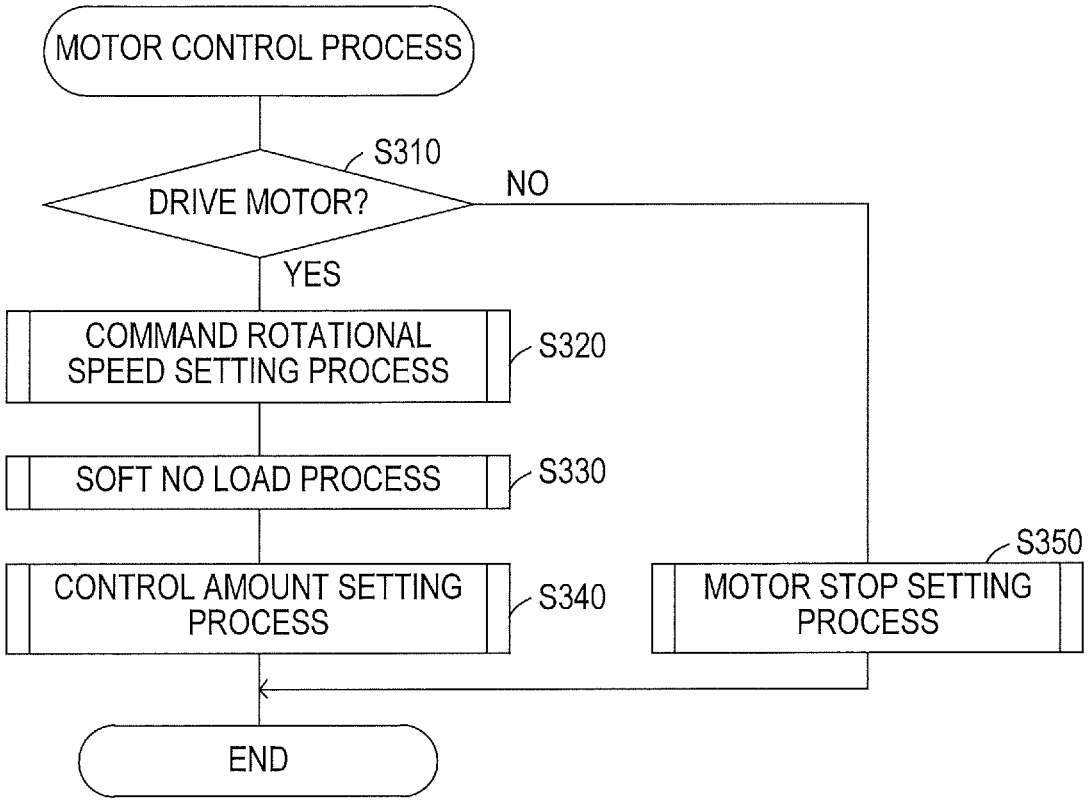
FIG. 7 is a flow chart showing details of a motor control process shown in FIG. 5.

As shown in FIG. 7, in motor control process in S140, whether the motor 8 should be driven based on motor drive conditions is first determined in S310.

In this embodiment, the motor drive conditions are satisfied when the trigger switch 18*a* is in the on state, the voltage value, the current value, and the temperature retrieved in S130 are normal, and no twisted-motion of the main body housing 10 is detected by the twisted-motion detector 90 (no-error signal input).

When the motor drive conditions are satisfied and if it is determined that the motor 8 should be driven in S310, the process proceeds to S320 and command rotational speed setting process is executed. In this command rotational speed setting process, the command rotational speed is set in accordance with a signal from the speed change commander 18*b* and an upper limit rotational speed set through the upper-limit speed setter 96.

In the following S330, soft no load process is executed. In soft no load process, when the tool bit 4 is in the no load state, the command rotational speed of the motor 8 is limited below a predetermined no-load rotational speed Nth.

In the following S340, control amount setting process is executed. In this control amount setting process, the drive duty ratio for the motor 8 is set according to the command rotational speed set in S320 or limited below the predetermined no-load rotational speed Nth in S330. Upon completion of this control amount setting process, the motor control process is terminated.

It should be noted that in S340, the drive duty ratio is set such that the drive duty ratio does not rapidly change in accordance with a change of the command rotational speed from the rotational speed set by a trigger operation or the like to the no-load rotational speed or toward the side opposite to this.

In other words, in S340, the rate of change in the drive duty ratio (i.e., the gradient of change) is limited so that the rotational speed of the motor 8 can gradually change. This is for restraining a rapid change in the rotational speed of the motor 8 when the tool bit 4 is made in contact with the work piece or separated from the work piece.

When the motor drive conditions are not satisfied and if it is determined that the motor 8 should not be driven in S310, the process proceeds to S350 and a motor stop setting process for setting a stop of drive of the motor 8 is executed and the motor control process is terminated.

Figure 8:
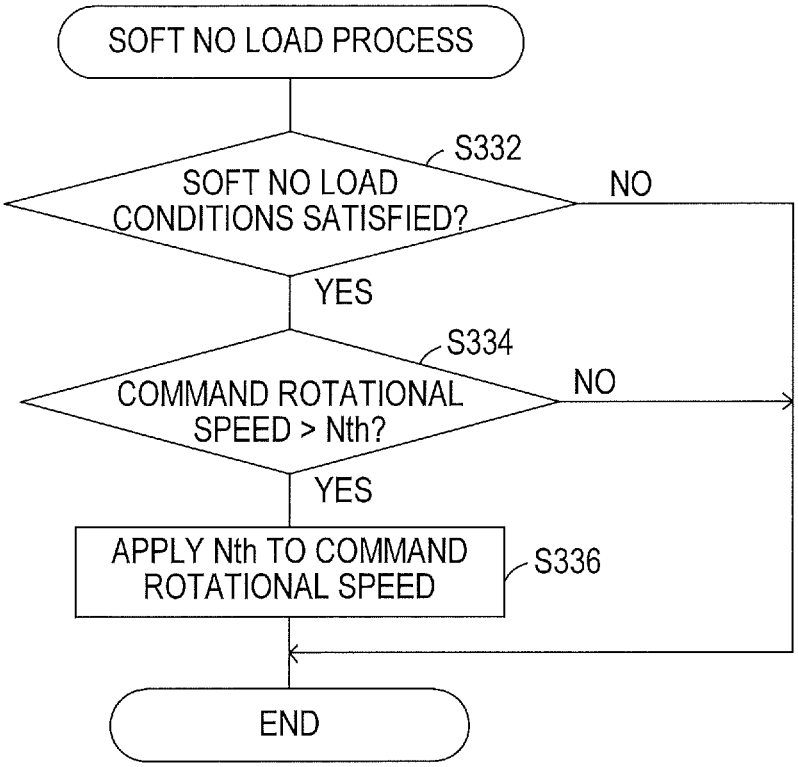
FIG. 8 is a flow chart showing details of a soft no load process shown in FIG. 7.

As shown in FIG. 8, in soft no load process in the following S330, whether soft no load control execution conditions (soft no load conditions) are satisfied is first determined in S332. Under soft no load control, the command rotational speed of the motor 8 is limited at or below the no-load rotational speed Nth.

Figure 9:
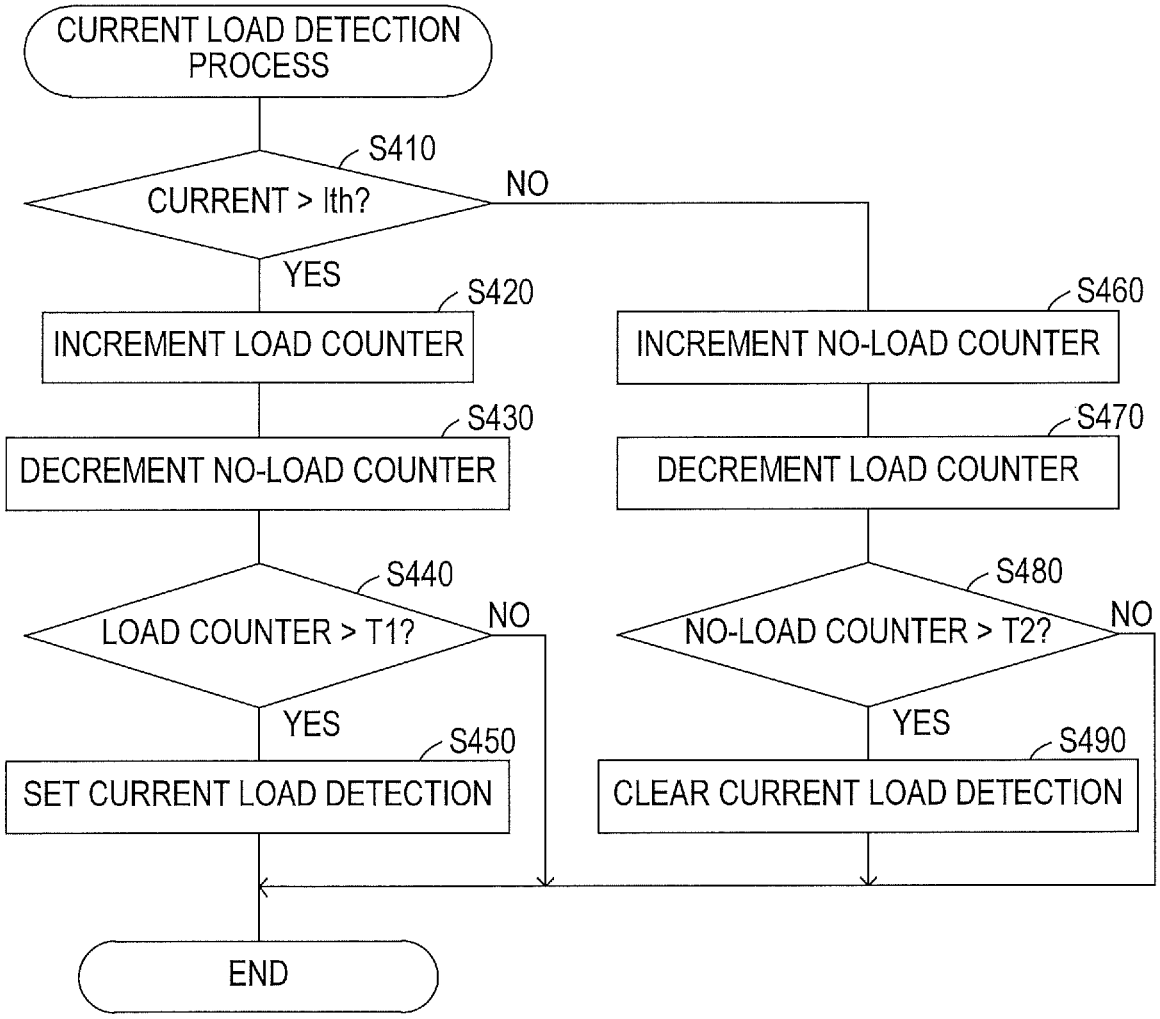
FIG. 9 is a flow chart of a current load detection process executed in an A/D conversion process shown in FIG. 5.

In this embodiment, soft no load conditions are satisfied in current load detection process shown in FIG. 9 and in the acceleration detecting circuit 94 in the twisted-motion detector 90, when the tool bit 4 is determined to be in the no-load-imposed state and the dust collector device 66 is not mounted to the hammer drill 2.

If it is determined that the soft no load conditions are satisfied in S332, the process proceeds to S334 and whether the command rotational speed exceeds the no-load rotational speed Nth (e.g., 11000 rpm) is determined. This no-load rotational speed Nth corresponds to the upper limit rotational speed of soft no load control.

If the command rotational speed is determined to exceed the no-load rotational speed Nth in S334, the process proceeds to S336 in which the no-load rotational speed Nth is applied to the command rotational speed, and the soft no load process is terminated.

If it is determined that the soft no load conditions are not satisfied in S332 or that the command rotational speed does not exceed the no-load rotational speed Nth in S334, the soft no load process is immediately terminated.

To summarize, in the soft no load process, the command rotational speed is limited at or below the no-load rotational speed Nth if the tool bit 4 is determined to be in the no-load-imposed state in both the current load detection process in FIG. 9 and the acceleration detecting circuit 94, and when the dust collector device 66 is not mounted to the hammer drill 2.

In the A/D conversion process in S130, the current load detection process in FIG. 9 is executed for determining whether the tool bit 4 is in the no-load-imposed state in accordance with the current value retrieved from the current detection circuit 74.

In this current load detection process, first, in S410, whether the value retrieved through A/D conversion (detect current value) exceeds a current threshold Ith is determined. This current threshold Ith is a value predetermined to determine whether a load is imposed on the tool bit 4.

If the detected current value exceeds the current threshold Ith, a load counter for load determination is incremented (+1) in S420, a no-load counter for no-load determination is decremented (−1) in S430, and the process proceeds to S440.

In S440, whether the value of the load counter exceeds a load determination value T1 is determined. The load determination value T1 is a value predetermined to determine whether a load is imposed on the tool bit 4. If the value of the load counter exceeds the load determination value T1, the process proceeds to S450 and a current load detecting flag is set, and the current load detection process is then terminated.

If the value of the load counter does not exceed the load determination value T1, the current load detection process is immediately terminated. The current load detecting flag indicates that the tool bit 4 is in the load-imposed state, and is used to detect the fact (a current load) that the load-imposed state of the tool bit 4 is detected from a current value in S332 of the soft no load process.

If the detected current value is determined to be at or below the current threshold Ith in S410, the process proceeds to S460 in which the no-load counter is incremented (+1), and to the following S470 in which the load counter is decremented (−1).

In the following S480, whether the value of the no-load counter exceeds a no-load determination value T2 is determined. The no-load determination value T2 is a value predetermined to determine whether the tool bit 4 is in the no-load-imposed state. If the value of the no-load counter exceeds the no-load determination value T2, the process proceeds to S490 and the tool bit 4 is determined to be in the no-load-imposed state, so that the current load detecting flag is cleared and the current load detection process is terminated.

If the value of the no-load counter does not exceed the no-load determination value T2, the current load detection process is immediately terminated.

The load counter measures the time during which the detected current value exceeds the current threshold Ith. In the current load detection process, whether the time measured by the load counter has reached a predetermined time is determined by using the load determination value T1. The no-load counter measures the time during which the detected current value does not exceed the current threshold Ith. In the current load detection process, whether the time measured by the no-load counter has reached a predetermined time is determined by using the no-load determination value T2.

In this embodiment, the load determination value T1 is smaller than the no-load determination value T2 (i.e., the time measured by the load counter is shorter than the time measured by the no-load counter). This is for detecting the load-imposed state of the tool bit 4 more rapidly so that the rotational speed of the motor 8 can be set to a command rotational speed dependent on the amount of the operation of the trigger. The load determination value T1 is set to a value corresponding to, for example, 100 ms, and the no-load determination value T2 is set to a value corresponding to, for example, 500 ms.

Figure 10:
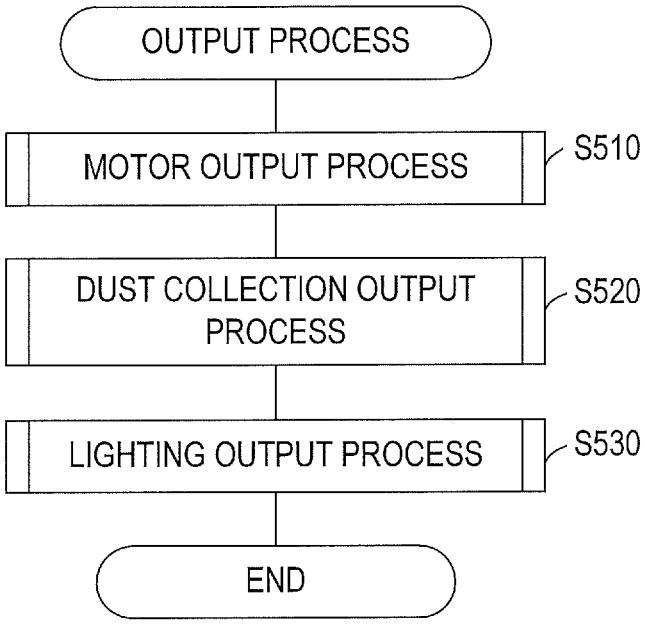
FIG. 10 is a flow chart showing details of an output process shown in FIG. 5.

As shown in FIG. 10, in output process in S150, motor output process is first executed in S510. In the motor output process, a control signal for driving the motor 8 at the command rotational speed, and a rotation direction signal for designating the rotation direction are transmitted to the drive circuit 72.

In the following S520, a dust collection output process is executed for transmitting a drive signal for the dust collector motor 67 to the dust collector device 66 mounted to the hammer drill 2. Subsequently, a lighting output process is executed for transmitting a drive signal to the lighting LED 84 to turn on the lighting LED 84 in S530, and the output process is terminated.

In S530, if the dust collector device 66 is mounted to the hammer drill 2, a drive signal is transmitted to the lighting LED 68, which is provided to the dust collector device 66, to turn on the lighting LED 68.

Figure 11:
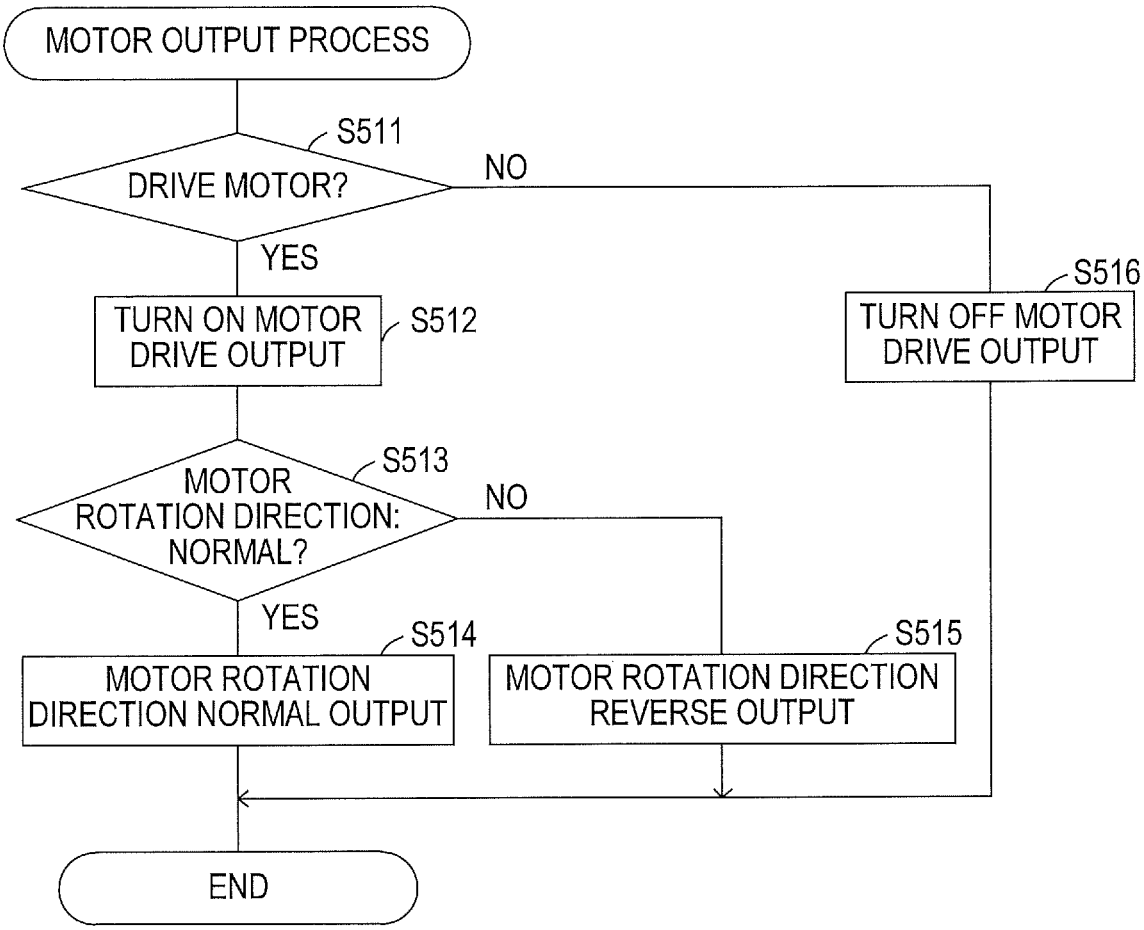
FIG. 11 is a flow chart showing details of a motor output process shown in FIG. 10.

As shown in FIG. 11, in motor output process in S510, whether the motor 8 should be driven is first determined in S511. Process in S511 is executed in a manner similar to that for S310 in the motor control process.

In other words, in S511, whether the motor drive conditions are satisfied is determined. These motor drive conditions are satisfied when the trigger switch 18*a* is in the on state, the voltage value, the current value, and the temperature retrieved in S130 are normal, and no twisted-motion of the main body housing 10 is detected by the twisted-motion detector 90 (no-error signal input).

When the motor drive conditions are satisfied and if it is determined that the motor 8 should be driven in S511, the process proceeds to S512 and transmission of a control signal to the drive circuit 72 is started.

In the following S513, whether the direction of the rotation of the motor 8 is the normal direction (forward direction) is determined. If the direction of the rotation of the motor 8 is the normal direction (forward direction), the process proceeds to S514 in which a rotation direction signal that designates the "forward direction" as the direction of the rotation of the motor 8 is transmitted to the drive circuit 72, and the motor output process is terminated.

If it is determined that the direction of the rotation of the motor 8 is not the normal direction in S513, the process proceeds to S515 in which a rotation direction signal that designates the "reverse direction" as the direction of the rotation of the motor 8 is transmitted to the drive circuit 72, and the motor output process is terminated.

When the motor drive conditions are not satisfied and if it is determined that the motor 8 should not be driven in S511, the process proceeds to S516 and transmission of a control signal to the drive circuit 72 is stopped.

Next, an acceleration load detecting process and twisted-motion detecting process executed in the acceleration detecting circuit 94 of the twisted-motion detector 90 will be explained with reference to the flow charts of FIGS. 12, 13A, and 13B.

Figure 12:
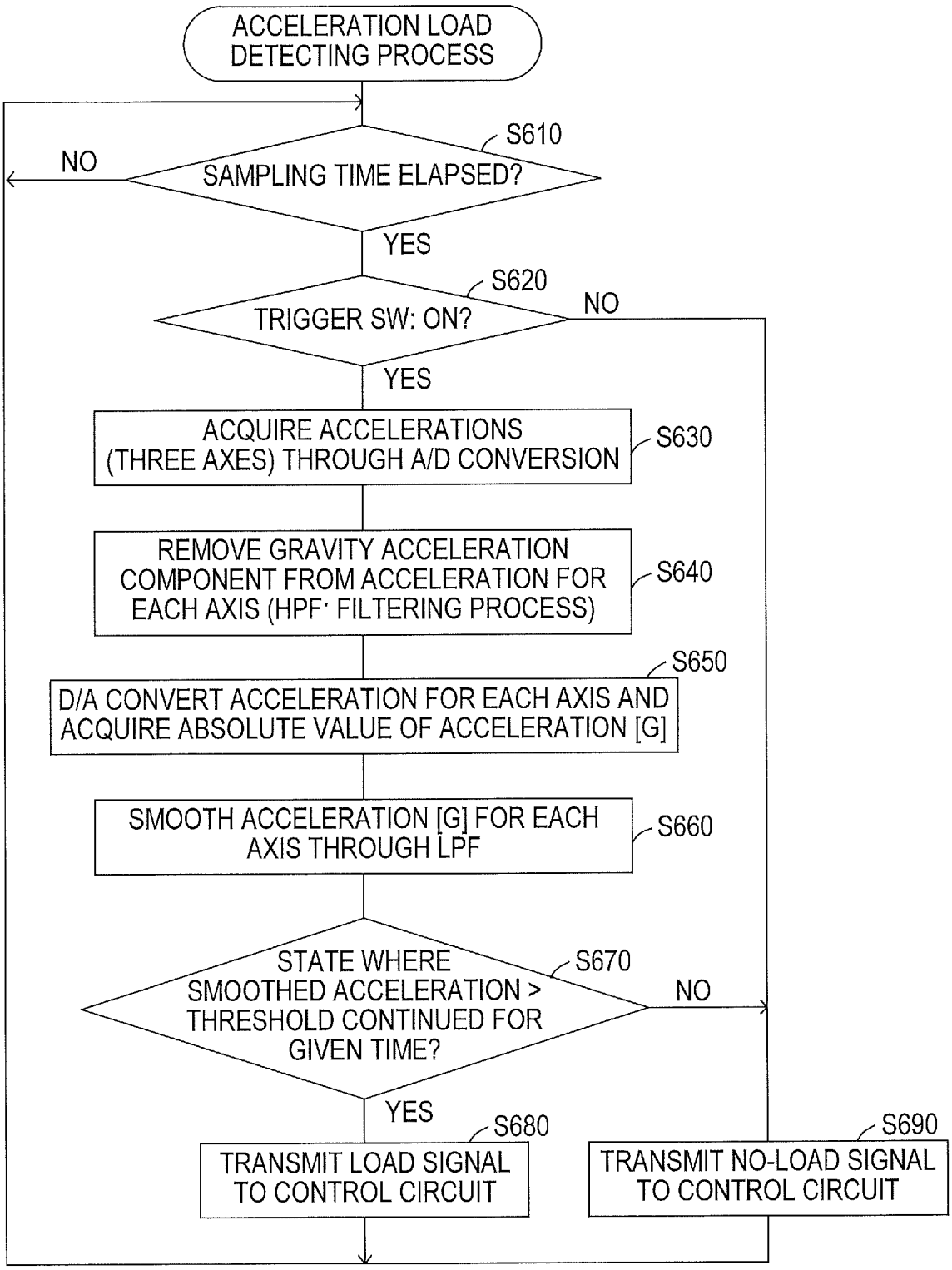
FIG. 12 is a flow chart of an acceleration load detecting process executed in an acceleration detecting circuit in a twisted-motion detector.

As shown in FIG. 12, for the acceleration load detecting process, in S610, whether a sampling time predetermined to judge load application to the tool bit 4 has elapsed is determined. In other words, a waiting time lasts until the elapse of the given sampling time since the previous process executed in S620.

If it is determined that the sampling time has elapsed in S610, the process proceeds to S620 in which whether the trigger switch 18*a* is in the on state (i.e., whether there is an input of a drive command of the motor 8 from the user) is determined.

If it is determined that the trigger switch 18*a* is in the on state in S620, the process proceeds to S630. Accelerations in the directions of the three axes (X, Y, and Z) is retrieved from the acceleration sensor 92 through A/D conversion in S630, and the retrieved acceleration data is subjected to a filtering process for removing gravity acceleration components from acceleration data related to the directions of the three axes in the following S640.

The filtering process in S640 functions as a high-pass filter (HPF) with a cut-off frequency of about 1 to 10 Hz for removing low-frequency components corresponding to gravity acceleration.

After the accelerations in the directions of the three axes is subjected to the filtering process in S640, the process proceeds to S650 in which the accelerations in the directions of the three axes after the filtering process is D/A converted and, for example, acceleration signals in the directions of the three axes after D/A conversion are subjected to full-wave rectification to obtain the absolute values of the respective accelerations [G] in the directions of the three axes.

The absolute values obtained in S650 are smoothed using a low-pass filter (LPF) to obtain the respective smoothed accelerations in the following S660, and the process proceeds to S670.

In S670, the respective smoothed accelerations are compared with a threshold predetermined to determine whether a load is imposed on the tool bit 4, and whether the state where any of the smoothed accelerations exceeds the threshold has continued for over a given time is determined.

If it is determined that the state where any of the smoothed accelerations exceeds the threshold has continued for over the given time in S670, the tool bit 4 is determined to be in the load-imposed state and the process proceeds to S680. Subsequently, a load signal is transmitted to the control circuit 80 in S680, and the process proceeds to S610.

If it is determined that the state where any of the smoothed accelerations exceeds the threshold has not continued for over the given time in S670 or if it is determined that the trigger switch 18*a* is in the off state in S620, the process proceeds to S690.

In S690, a no-load signal is transmitted to the control circuit 80 to notify the control circuit 80 that the tool bit 4 is in the no-load-imposed state. The process then proceeds to S610.

Consequently, the control circuit 80 retrieves a load signal or no-load signal from the acceleration detecting circuit 94 and can therefore determine whether the load-imposed state (acceleration load) of the tool bit 4 is detected or whether the soft no load conditions are satisfied.

Figure 13A:
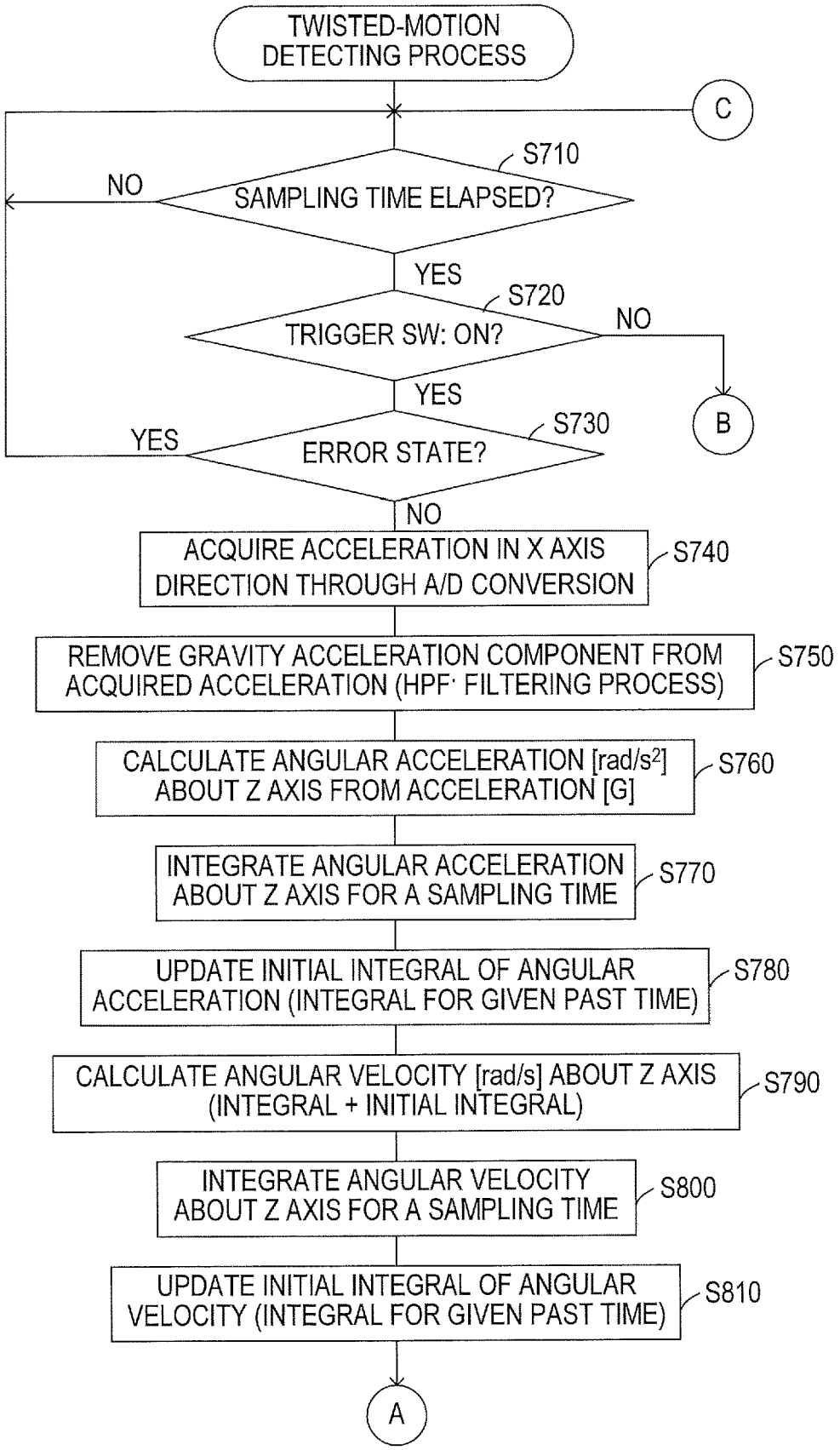
FIG. 13A is a flow chart of a twisted-motion detecting process executed in the acceleration detecting circuit in the twisted-motion detector.
Figure 13B:
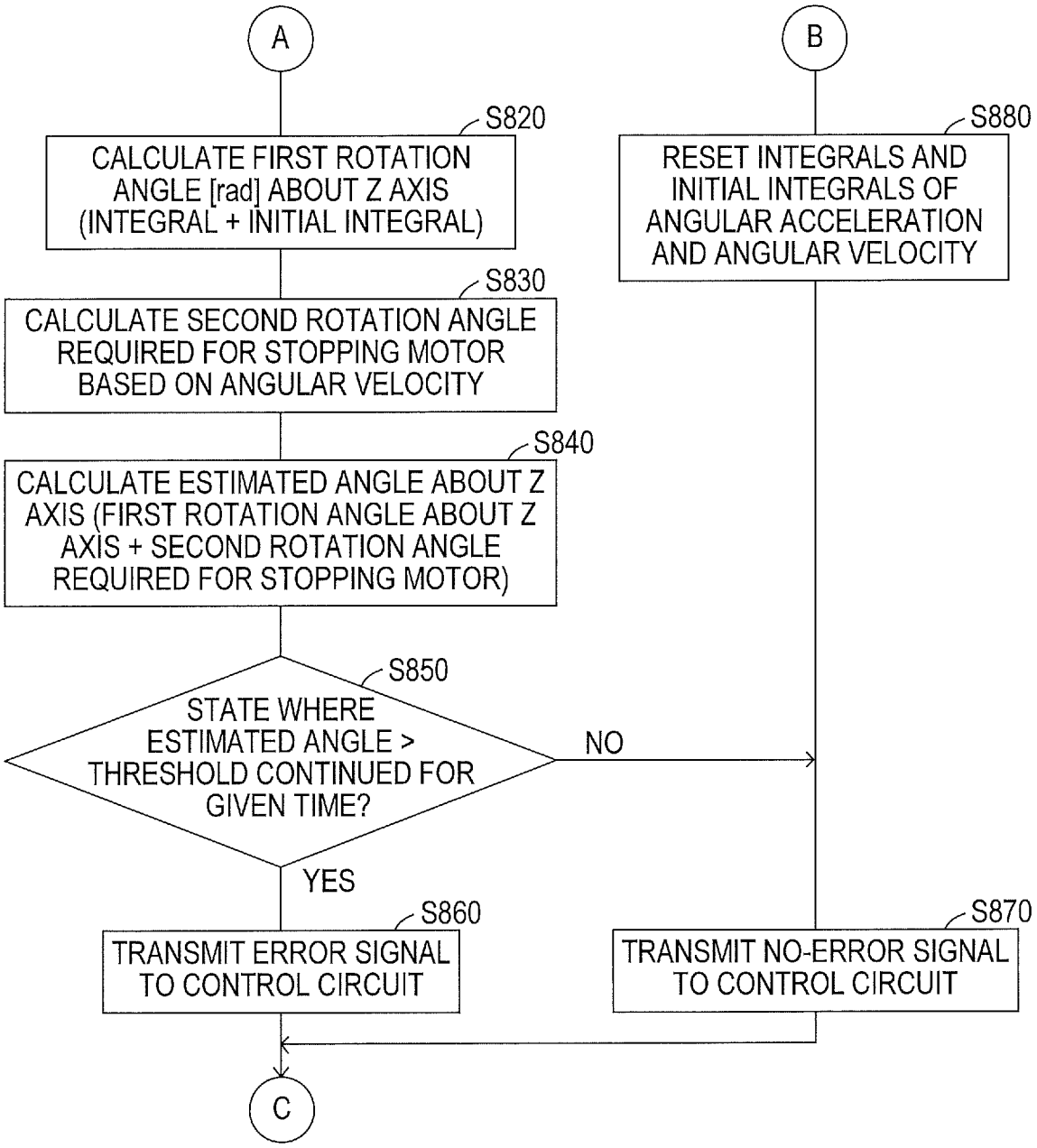
FIG. 13B is a flow chart showing the rest of the twisted-motion detecting process.

As shown in FIGS. 13A and 13B, in the twisted-motion detecting process, whether a sampling time predetermined to detect a twisted-motion has elapsed is determined in S710. In other words, a waiting time lasts until the elapse of the given sampling time since the previous process executed in S720.

Subsequently, if it is determined that the sampling time has elapsed in S710, the process proceeds to S720 in which whether the trigger switch 18*a* is in the on state is determined. If the trigger switch 18*a* is in the on state, the process proceeds to S730.

In S730, twisting of the hammer drill 2 is detected in the twisted-motion detecting process and whether the error state is currently occurring is determined. If the error state is occurring, the process proceeds to S710. If the error state is not occurring, the process proceeds to S740.

In S740, the acceleration in the direction of the X axis is retrieved from the acceleration sensor 92 through A/D conversion. In the following S750, as in the above-described S640, gravity acceleration components are removed from the retrieved data of the acceleration in the direction of the X axis in a filtering process functioning as an HPF.

Subsequently, in S760, the angular acceleration [rad/s$^2$] about the Z axis is calculated from the acceleration [G] in the direction of the X axis after the filtering process by using the following expression. The process then proceeds to S770.

$$\text{angular acceleration} = \text{acceleration } G \times 9.8 / \text{distance } L \qquad \text{Expression:}$$

In this expression, distance L is the distance between the acceleration sensor 92 and the Z axis.

In S770, the angular acceleration obtained in S760 is integrated for a sampling time. In the following S780, the initial integral of the angular acceleration is updated. This initial integral is the integral of the angular acceleration for a given past time. Since the angular acceleration has been additionally calculated in S760, the integral of the angular acceleration that has been sampled for a sampling time more than a given time ago is removed from the initial integral in S780.

In the following S790, the angular velocity [rad/s] about the Z axis is calculated by addition of the initial integral of the angular acceleration updated in S780 and the latest integral of the angular acceleration calculated in S770.

In S800, the angular velocity calculated in S790 is integrated for a sampling time. In the following S810, the initial integral of the angular velocity is updated. This initial integral is the integral of the angular velocity for a past given time. Since the angular velocity has been additionally calculated in S790, the integral of the angular velocity that has been obtained for a sampling time more than a given time ago is removed from the initial integral in S810.

In the following S820, the first rotation angle [rad] about the Z axis related to the hammer drill 2 is calculated by addition of the initial integral of the angular velocity updated in S810 and the latest integral of the angular velocity calculated in S800.

In S830, the second rotation angle of the hammer drill 2 required for actually stopping the motor 8 after twisting of the hammer drill 2 about the Z axis is detected is calculated based on the current angular velocity determined in S790. The process then proceeds to S840. This rotation angle is calculated by multiplying the angular velocity by a predetermined estimated time (rotation angle=angular velocity× estimated time).

In S840, an estimated angle is calculated by adding the second rotation angle calculated in S830 to the first rotation angle about the Z axis calculated in S820. This estimated angle corresponds to the rotation angle about the Z axis including the rotation angle after twisted-motion detection (i.e., the second rotation angle).

In S850, whether the state where the estimated angle calculated in S840 exceeds a threshold angle predetermined to detect a twisted-motion has continued for more than a given time is determined.

If yes in S850, the process proceeds to S860 to transmit an error signal to the control circuit 80. In other words, the fact that the tool bit 4 fits the work piece during drilling of the work piece and a twisted-motion of the hammer drill 2 has started is notified to the control circuit 80.

Consequently, the control circuit 80 determines that the motor drive conditions are not satisfied and stops drive of the motor 8, thereby restraining a large amount of twisting of the hammer drill 2. After execution of the process in S860, this process proceeds to S710 again.

On the contrary, if no in S850, the process proceeds to S870 to transmit a no-error signal to the control circuit 80. In other words, the fact that the hammer drill 2 is not twisted is notified to the control circuit 80. After execution of the process in S870, this process proceeds to S710 again.

In S720, if it is determined that the trigger switch 18*a* is not in the on state, the operation of the hammer drill 2 stops; thus, the process proceeds to S880 to reset the integrals and the initial integrals of angular acceleration and angular velocity. The process then proceeds to S870.

As described above, in the hammer drill 2 of this embodiment, the acceleration detecting circuit 94 of the twisted-motion detector 90 executes the twisted-motion detecting process to determine whether the main body housing 10 has been twisted about the Z axis (output shaft) during the rotative drive of the tool bit 4.

If twisting of the main body housing 10 about the Z axis is detected, the control circuit 80 stops drive of the motor 8, thereby restraining a large amount of twisting of the main body housing 10.

In the twisted-motion detecting process, a signal of acceleration in the direction of the X axis from the acceleration sensor 92 is sequentially subjected to sampling in a constant sampling cycle, and converted to angular acceleration about the Z axis. Integration of a value obtained by multiplying the angular acceleration acquired in a certain past time by sampling time yields an angular velocity, which is the integral of the angular acceleration.

Consequently, in this embodiment, the angular velocity about the Z axis can be detected more accurately than in the case where the acceleration signal is integrated using an integration circuit.

In other words, when the angular velocity about the Z axis is detected by input of acceleration signals to an integration circuit, the acceleration signals are integrated in sequence. Accordingly, errors are accumulated in the acquired angular velocity, decreasing the detection accuracy of the angular velocity.

Figure 14:
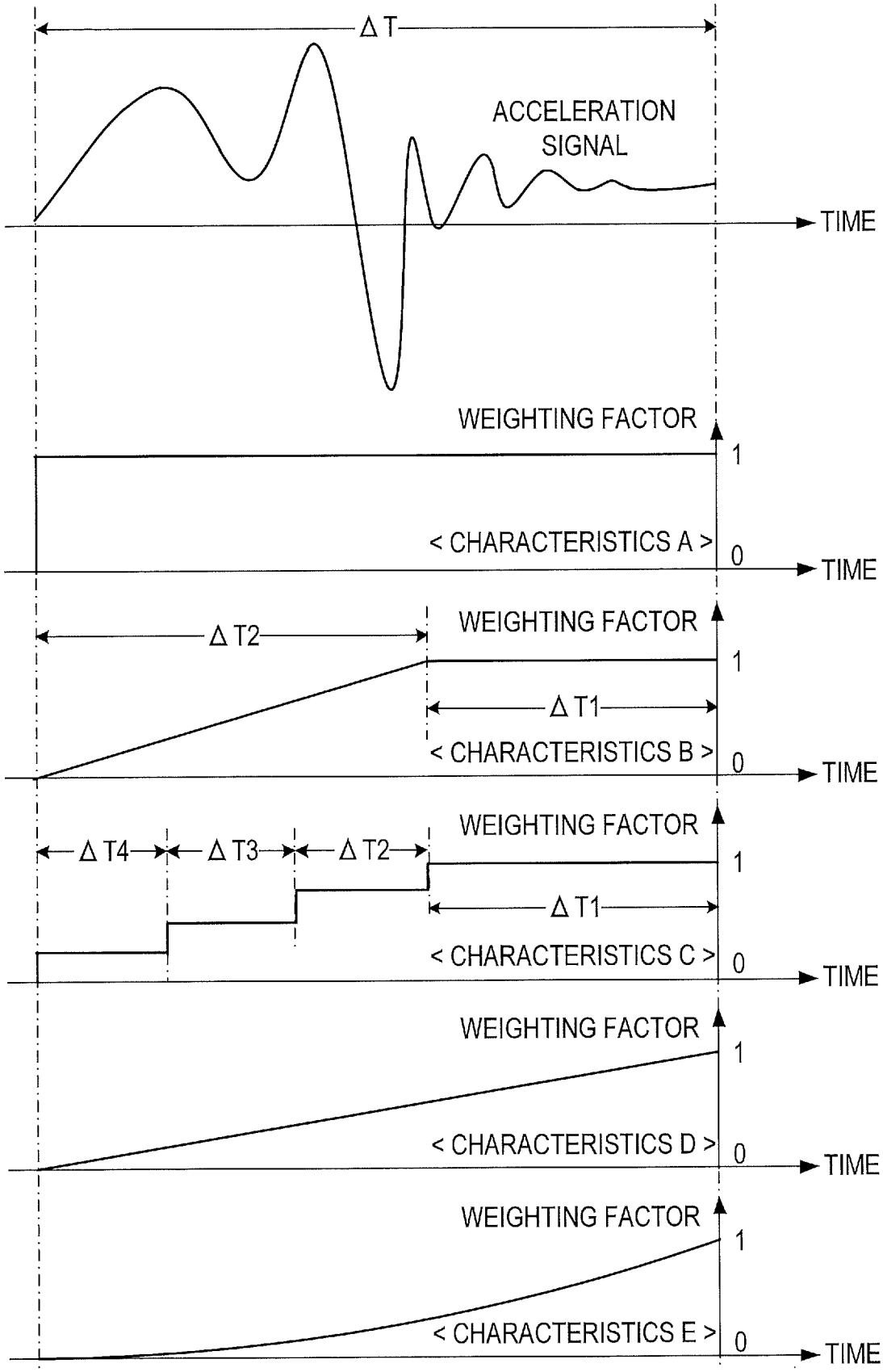
FIG. 14 is an explanation diagram for explaining integration of acceleration and speed executed in the twisted-motion detecting process shown in FIGS. 13A and 13B.

On the contrary, in this embodiment, as shown in FIG. 14, the angular velocity is calculated using only acceleration signals sampled within a certain past time ΔT. Accordingly, errors accumulated in the angular velocity due to noise and the like are reduced, and the detection accuracy of the angular velocity can be increased.

According to one example, in S780 shown in FIG. 13A, as indicated by characteristics A shown in FIG. 14, the initial integral may be calculated and updated by multiplying angular accelerations acquired within a certain past time by a weighting factor, which is a constant value of "1". In other words, to update the initial integral, the integral of the angular acceleration for each sampling period is calculated using the angular accelerations acquired within a certain past time without correction, and the calculated integral of the angular accelerations may be added together for the certain past time. The initial integral may be updated to this added total value.

In another example, as indicated by characteristics B to E shown in FIG. 14, angular accelerations acquired within a certain past time can be multiplied by different weighting factors. Each angular acceleration may be weighed such that the weight of the angular acceleration value becomes lower with the time elapsed from its acquisition. The angular acceleration longer after its acquisition may be allocated with a smaller weighting factor. Weighting of each angular acceleration may be achieved by multiplying the angular acceleration by a weighting factor. Each weighted angular acceleration may be multiplied by a sampling time to calculate the integral of the angular acceleration for each sampling period, and the calculated integral of the angular accelerations may be added together for the certain past time. The initial integral may be updated to this added total value.

Such weighting allows the latest angular acceleration to be largely reflected in the angular velocity calculated in S790.

The angular velocity calculated in this manner represents a twisted-motion about the Z axis of the main body housing 10 more faithfully. Accordingly, a twisted-motion of the main body housing 10 can be satisfactorily detected from that angular velocity.

Characteristics B shown in FIG. 14 define different weighting factors in a first period ΔT1 and a second period ΔT2, which is prior to the first period ΔT1, in the certain past time ΔT. The weighting factor that the angular acceleration in the first period ΔT1 is multiplied by is a value of "1". The weighting factor that the angular acceleration in the second period ΔT2 is multiplied by is a value smaller than the weighting factor by which the angular acceleration in the first period ΔT1 is multiplied. The angular acceleration in the second period ΔT2 longer after its acquisition is multiplied by a smaller weighting factor.

Characteristics C shown in FIG. 14 define different weighting factors in multiple periods ΔT1 to ΔT4 in the certain past time ΔT. These weighting factors are each defined by a different constant. The angular acceleration in the period ΔT2 prior to the latest period ΔT1 is multiplied by a weighting factor smaller than that for the period ΔT1. The angular acceleration in the period ΔT3 prior to the period ΔT2 is multiplied by a weighting factor smaller than that for the period ΔT2. The angular acceleration in the period ΔT4 prior to the period ΔT3 is multiplied by a weighting factor smaller than that for the period ΔT3.

Characteristics D and E shown in FIG. 14 show that all the angular accelerations acquired in the certain past time ΔT are multiplied by a weighting factor that varies continuously, such that the weight decreases with elapsed time. The characteristics D show the state where the rate of change of the weighting factor is made constant, and the characteristics E show the case where the rate of change of the weighting factor is made variable.

The electric power tool a twisted-motion of which is a target of detection may employ any suitable characteristics selected from the characteristics A to E shown in FIG. 14. The value of a weighting factor and the rage of change of the weighting factor can be set as appropriate.

In this embodiment, the calculated angular velocities for a certain past time are stored and integration of a value obtained by multiplying each angular velocity by sampling time yields a rotation angle, which is the integral of the angular velocity. This calculation of rotation angle may also employ the characteristics A to E shown in FIG. 14 as examples. Calculating a rotation angle in this manner can increase the accuracy of rotation angle.

In this embodiment, the twisting state of the main body housing 10 is determined using the calculated rotation angle. At the determination, the rotation angle required for stopping the motor 8 (the second rotation angle) is estimated, and the estimated rotation angle is added to the calculated rotation angle (the first rotation angle).

Accordingly, in this embodiment, an allowable rotation angle related to twisting of the main body housing 10 about the Z axis can be defined. In other words, upon detection of a twisted-motion, the rotation of the motor 8 (and thus the main body housing 10) can be stopped in a more appropriate timing.

In this embodiment, a detection signal (an acceleration signal) from the acceleration sensor 92 is subjected to a filtering process using a digital filter serving as a high-pass filter. The acceleration detecting circuit 94 is configured to obtain acceleration from a detection signal resulting from the filtering process.

Thus, higher accuracy of acceleration detection can be obtained than with a process in which a detection signal from the acceleration sensor 92 is processed through an analog filter (a high-pass filter).

In other words, a detection signal from the acceleration sensor 92 fluctuates with acceleration imposed on the main body housing 10, and the center of the fluctuation is the ground voltage when no power is supplied to the hammer drill 2.

Figure 15:
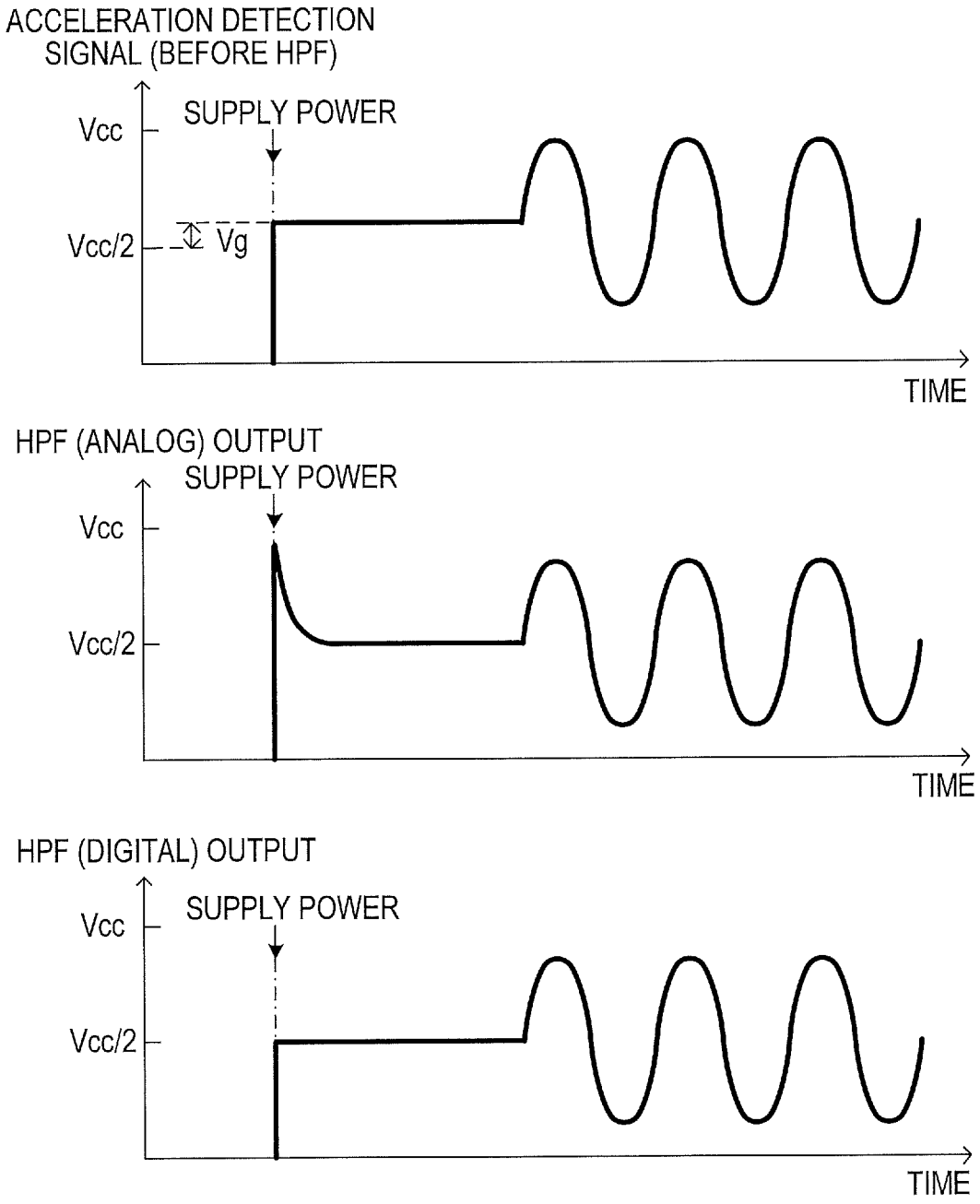
FIG. 15 is a diagram for explaining an operation of a high-pass filter in detection process shown in FIGS. 12, 13A, and 13B by a comparison with that of an analog filter.

As shown in the upper diagram in FIG. 15, when the hammer drill 2 is supplied with power, the center of the fluctuation of the detection signal is raised to a voltage determined by adding a gravity acceleration component (Vg) to the reference voltage of the input circuit. The reference voltage is typically the middle voltage Vcc/2 of the power source voltage Vcc.

Upon supply of power to the hammer drill 2, drive of the motor 8 is stopped and no acceleration usually occurs in the main body housing 10. Accordingly, an input signal (i.e., a detection signal) from the acceleration sensor 92 rises to a constant voltage of "(Vcc/2)+Vg".

When this detection signal is input to an analog filter (high-pass filter: HPF) to remove a gravity acceleration component (Vg), the output of the analog filter fluctuates as shown in the middle drawing of FIG. 15. In other words, the output of the analog filter rapidly rises upon supply of power and exceeds the reference voltage (Vcc/2). Afterwards, the output eventually decreases to the reference voltage (Vcc/2). Thus, it takes a certain time for the output of the analog filter to go into the stable state.

On the contrary, when a detection signal related to acceleration is subjected to a filtering process using a digital filter as in this embodiment, as shown in the lower drawing of FIG. 15, the signal level of the detection signal immediately after supply of power can be set to the initial value. Accordingly, the detection signal (data) does not fluctuate.

Accordingly, in this embodiment, acceleration can be accurately detected from immediately after supply of power to the hammer drill 2.

Further, the twisted-motion detector 90 is separate from the motor controller 70, which leads to a size smaller than that given by integration of the twisted-motion detector 90 with the motor controller 70. Accordingly, the twisted-motion detector 90 can be disposed by effectively using a space in the main body housing 10. The twisted-motion detector 90 can be disposed in a position where it can easily detect the behavior (acceleration) of the main body housing 10.

The present disclosure is not limited to the above-described embodiment and various modifications can be made for implementation.

For example, to detect a twisted-motion, the rotation angle about the Z axis of the main body housing 10 is not necessarily determined. A twisted-motion may be detected from the angular velocity about the Z axis of the main body housing 10.

Acceleration in the direction of the X axis may be integrated in the similar manner to determine the speed in the direction of the X axis, and a twisted-motion may be detected from the speed. The speed in the direction of the X axis may be integrated to determine the rotation angle about the Z axis of the main body housing 10, and a twisted-motion may be detected from the rotation angle.

The present disclosure is not limited to application to the hammer drill 2. A technique in the present disclosure may be applied to electric power tools with various rotation systems configured to rotate a tool bit, for example, a drilling tool, a fastener tool, and the like for drilling of a work piece, fastening of a screw or a bolt, and the like.

Multiple functions of one component in the above-described embodiment may be implemented by multiple components, or one function of one component may be implemented by multiple components. In addition, multiple functions of multiple components may be implemented by one component, or one function implemented by multiple components may be implemented by one component. Further, part of the structure of the above-described embodiment can be omitted. Moreover, at least part of the above-described embodiment can be added to or replaced by another structure of the above-described embodiment. It should be noted that any mode included in technical ideas specified by the words in the claims is the embodiment of the present disclosure.

What is claimed is:

1. An electric power tool comprising:

a housing;

a motor that is housed in the housing;

an output shaft that is housed in the housing and includes a first end for attachment to a tool bit, the output shaft being configured to be rotatively driven by the motor and configured to rotate the tool bit about a Z-axis; and a twisted-motion detector that is configured to detect twisting of the housing, wherein the twisted-motion detector includes:

a three-axes acceleration sensor configured to measure accelerations of the housing including a first axis acceleration along a first axis, a second axis acceleration along a second axis, and a third axis acceleration along a third axis; and an acceleration detection circuit configured to:

determine an X-axis acceleration along an X-axis orthogonal to the Z-axis without a gravity acceleration component based on an input signal from the three-axes acceleration sensor;

calculate an angular acceleration of the housing about the Z-axis from the X-axis acceleration;

calculate a change in an angular velocity based on integrating the angular acceleration for a most recent period;

determine a Z-axis angular velocity about the Z-axis as equal to the change in the angular velocity, without adding a previous change in the angular velocity from before the most recent period; and detect a twisted-motion of the housing based on the Z-axis angular velocity.

2. The electric power tool according to claim 1, wherein:

calculating the change in the angular velocity based on integrating the angular acceleration for the most recent period is defined as:

integrating the angular acceleration during a first period while including a first weighting factor; and integrating the angular acceleration during a second period while including a second weighting factor, the second period occurs before the first period, the most recent period equals the second period plus the first period, and the second weighting factor is smaller than the first weighting factor.

3. The electric power tool according to claim 2, wherein:

the first weighting factor is constant, and the second weighting factor monotonically increases from zero to the first weighting factor during the second period.

4. The electric power tool according to claim 3, wherein the second weighting factor linearly increases from zero to the first weighting factor during the second period.

5. The electric power tool according to claim 1, wherein:

calculating the change in the angular velocity based on integrating the angular acceleration for the most recent period is defined as integrating the angular acceleration during the most recent period while including a weighting factor in the most recent period, and the weighting factor increases in a step-wise manner during the most recent period.

6. The electric power tool according to claim 1, wherein:

calculating the change in the angular velocity based on integrating the angular acceleration for the most recent period is defined as:

integrating the angular acceleration during a first period while including a constant first weighting factor;

integrating the angular acceleration during a second period while including a constant second weighting factor;

integrating the angular acceleration during a third period while including a constant third weighting factor; and integrating the angular acceleration during a fourth period while including a constant fourth weighting factor, the fourth period occurs before the third period, the third period occurs before the second period, the second period occurs before the first period, the most recent period equals the fourth period plus the third period, the second period, and the first period, the fourth weighting factor is smaller than the third weighting factor, the third weighting factor is smaller than the second weighting factor, and the second weighting factor is smaller than the first weighting factor.

7. The electric power tool according to claim 1, wherein calculating the change in the angular velocity based on integrating the angular acceleration for the most recent period is defined as:

integrating the angular acceleration during the most recent period while including a weighting factor monotonically increasing during the most recent period.

8. The electric power tool according to claim 1, wherein calculating the change in the angular velocity based on integrating the angular acceleration for the most recent period is defined as:

integrating the angular acceleration during the most recent period while including a weighting factor linearly increasing during the most recent period.

9. The electric power tool according to claim 1, wherein calculating the change in the angular velocity based on integrating the angular acceleration for the most recent period is defined as:

integrating the angular acceleration during the most recent period while including a weighting factor non-linearly increasing during the most recent period.

10. The electric power tool according to claim 1, wherein the acceleration detection circuit is configured to filter the input signal from the acceleration sensor by a digital filter, and determine the X-axis acceleration without the gravity acceleration component based on the input signal filtered.

11. The electric power tool according to claim 10, wherein the digital filter includes a high-pass filter.

12. The electric power tool according to claim 1, wherein detecting the twisted-motion of the housing based on the Z-axis angular velocity is defined as:

calculating a change in angle based on integrating the Z-axis angular velocity for the most recent period, determining a present rotation angle about the Z-axis as equal to the change in angle, without adding a previous change in angle from before the most recent period, and detecting the twisted-motion of the housing based on the present rotation angle.

13. The electric power tool according to claim 12, wherein detecting the twisted-motion of the housing based on the present rotation angle is defined as:

calculating an estimated rotation angle based on the present rotation angle and a present Z-axis angular velocity, the estimated rotation angle being a rotation angle during a time until when the tool bit stops, and detecting the twisted-motion of the housing based on comparing the estimated rotation angle and a threshold rotation angle.

14. An electric power tool comprising:

a housing;

a motor that is housed in the housing;

an output shaft that is housed in the housing and includes a first end for attachment to a tool bit, the output shaft being configured to be rotatively driven by the motor and configured to rotate the tool bit about a Z-axis; and a twisted-motion detector that is configured to detect twisting of the housing, wherein the twisted motion detector includes:

a three-axes acceleration sensor is configured to measure accelerations of the housing including a first axis acceleration along a first axis, a second acceleration along a second axis, and a third acceleration along a third axis; and an acceleration detection circuit configured to:

calculate an angular acceleration of the housing about the Z-axis based on an input signal from the three-axes acceleration sensor;

calculate a change in an angular velocity based on integrating the angular acceleration for a most recent period;

determine a Z-axis angular velocity about the Z-axis as equal to the change in the angular velocity, without adding a previous change in the angular velocity from before the most recent period; and detect a twisted-motion of the housing based on the Z-axis angular velocity, and wherein:

calculating the change in an angular velocity based on integrating the angular acceleration for the most recent period is defined as:

integrating the angular acceleration during a first period while including a first weighting factor; and integrating the angular acceleration during a second period while including a second weighting factor, the second period occurs before the first period, the most recent period equals the second period plus the first period, and the second weighting factor is smaller than the first weighting factor.

15. The electric power tool according to claim 14, wherein:

the first weighting factor is constant, and the second weighting factor monotonically increases from zero to the first weighting factor during the second period.

16. The electric power tool according to claim 15, wherein the second weighting factor linearly increases from zero to the first weighting factor during the second period.

17. The electric power tool according to claim 14, wherein the second weighting factor increases in a step-wise manner from zero to the first weighting factor during the second period.

18. The electric power tool according to claim 14, wherein calculating the change in the angular velocity based on integrating the angular acceleration for the most recent period is defined as:

integrating the angular acceleration during the most recent period while the second weighting factor monotonically increases during the second period.

19. The electric power tool according to claim 14, wherein detecting the twisted-motion of the housing based on the Z-axis angular velocity is defined as:

calculating a change in angle based on integrating the Z-axis angular velocity for the most recent period;

determining a present rotation angle about the Z-axis as equal to the change in angle, without adding a previous change in angle from before the most recent period; and detecting the twisted-motion of the housing based on the present rotation angle.

20. The electric power tool according to claim 19, wherein detecting the twisted-motion of the housing based on the present rotation angle is defined as:

calculating an estimated rotation angle based on the present rotation angle and a present Z-axis angular velocity, the estimated rotation angle being a rotation angle during a time until the tool bit stops; and detecting the twisted-motion of the housing based on comparing the estimated rotation angle and a threshold rotation angle.

* * * * *